US010629113B2

(12) United States Patent
Ikeda et al.

(10) Patent No.: US 10,629,113 B2
(45) Date of Patent: Apr. 21, 2020

(54) DISPLAY DEVICE AND METHOD FOR OPERATING THE SAME

(71) Applicant: Semiconductor Energy Laboratory Co., Ltd., Kanagawa-ken (JP)

(72) Inventors: Takayuki Ikeda, Kanagawa (JP); Yoshiyuki Kurokawa, Kanagawa (JP)

(73) Assignee: Semiconductor Energy Laboratory Co., Ltd. (JP)

( * ) Notice: Subject to any disclaimer, the term of this patent is extended or adjusted under 35 U.S.C. 154(b) by 0 days.

(21) Appl. No.: 15/592,565

(22) Filed: May 11, 2017

(65) Prior Publication Data

US 2017/0337866 A1 Nov. 23, 2017

(30) Foreign Application Priority Data

May 17, 2016 (JP) ..... 2016-098455

(51) Int. Cl.
*G09G 3/20* (2006.01)

(52) U.S. Cl.
CPC ..... *G09G 3/2092* (2013.01); *G09G 3/20* (2013.01); *G09G 3/2096* (2013.01); *G09G 2310/08* (2013.01); *G09G 2330/021* (2013.01); *G09G 2360/127* (2013.01)

(58) Field of Classification Search
None
See application file for complete search history.

(56) References Cited

U.S. PATENT DOCUMENTS 6,025,840 A 2/2000 Taylor
6,058,464 A 5/2000 Taylor
6,118,461 A 9/2000 Taylor
6,900,813 B1 5/2005 Stefanidis
8,455,868 B2 6/2013 Yamazaki et al.
(Continued)

FOREIGN PATENT DOCUMENTS

JP 08-190373 A 7/1996
JP 10-510068 9/1998
(Continued)

OTHER PUBLICATIONS

International Search Report re Application No. PCT/IB2017/052678, dated Aug. 22, 2017.
(Continued)

*Primary Examiner* — Benjamin C Lee
*Assistant Examiner* — Krishna P Neupane
(74) *Attorney, Agent, or Firm* — Husch Blackwell LLP

(57) ABSTRACT

A display device that is driven with low power and a method for operating the display device are provided. The display device includes a host; a controller to which a first signal is supplied from the host; and a display panel to which a second signal is supplied from the controller. When the first signal includes image data, the first signal includes a command indicating the presence of the image data. When the controller detects the command, the controller supplies the image data as the second signal. When the controller does not detect the command, the controller stops supplying the second signal. After the controller stops supplying the second signal for a predetermined time, the controller resumes supplying the second signal regardless of whether or not the first signal includes the command.

4 Claims, 25 Drawing Sheets

(56) References Cited

U.S. PATENT DOCUMENTS

| | | | | |
|---|---|---|---|---|
| 8,477,158 | B2 | 7/2013 | Umezaki et al. | |
| 8,854,286 | B2 | 10/2014 | Yamazaki et al. | |
| 8,890,781 | B2 | 11/2014 | Yamazaki et al. | |
| 8,976,207 | B2 | 3/2015 | Umezaki et al. | |
| 9,013,389 | B2 | 4/2015 | Koyama et al. | |
| 9,165,502 | B2 | 10/2015 | Yamazaki et al. | |
| 9,349,735 | B2 | 5/2016 | Yamazaki et al. | |
| 9,368,082 | B2 | 6/2016 | Yamazaki et al. | |
| 9,478,704 | B2 | 10/2016 | Nishijima et al. | |
| 9,508,276 | B2 | 11/2016 | Hirakata et al. | |
| 2011/0175874 | A1* | 7/2011 | Wakimoto | G09G 3/3406 345/207 |
| 2012/0106226 | A1* | 5/2012 | Saito | G11C 11/404 365/51 |
| 2012/0140118 | A1* | 6/2012 | Tanaka | H04N 5/262 348/598 |
| 2013/0328948 | A1* | 12/2013 | Kunkel | G09G 3/22 345/690 |
| 2014/0111558 | A1 | 4/2014 | Ishitani et al. | |
| 2015/0009224 | A1* | 1/2015 | Tanaka | G09G 3/3648 345/534 |
| 2015/0130824 | A1* | 5/2015 | Lee | G06T 1/60 345/534 |
| 2016/0035275 | A1 | 2/2016 | Yamazaki et al. | |
| 2016/0042702 | A1 | 2/2016 | Hirakata et al. | |
| 2016/0232868 | A1 | 8/2016 | Yamazaki et al. | |
| 2016/0260718 | A1 | 9/2016 | Yamazaki et al. | |
| 2016/0283028 | A1 | 9/2016 | Yamazaki et al. | |
| 2016/0299387 | A1 | 10/2016 | Yamazaki et al. | |
| 2017/0004788 | A1 | 1/2017 | Yamazaki et al. | |
| 2017/0038641 | A1 | 2/2017 | Yamazaki | |
| 2017/0082882 | A1 | 3/2017 | Hirakata et al. | |
| 2017/0092177 | A1 | 3/2017 | Kobayashi et al. | |
| 2017/0103697 | A1 | 4/2017 | Kawashima et al. | |

FOREIGN PATENT DOCUMENTS

| | | | |
|---|---|---|---|
| JP | 2003-195847 | A | 7/2003 |
| JP | 2011-141522 | A | 7/2011 |
| JP | 2011-141524 | A | 7/2011 |
| JP | 2011-151383 | A | 8/2011 |
| JP | 2013-008936 | A | 1/2013 |
| KR | 2012-0046023 | A | 5/2012 |
| TW | 201230029 | | 7/2012 |
| TW | 201342352 | | 10/2013 |
| WO | WO 1997/014133 | A2 | 4/1997 |
| WO | WO 2013/140980 | A1 | 9/2013 |

OTHER PUBLICATIONS

Written Opinion re Application No. PCT/IB2017/052678, dated Aug. 22, 2017.

* cited by examiner

31

34

DISPLAY DEVICE AND METHOD FOR OPERATING THE SAME

TECHNICAL FIELD

One embodiment of the present invention relates to a display device and a method for operating the display device.

Furthermore, one embodiment of the present invention relates to a semiconductor device or a method for operating the semiconductor device. Note that one embodiment of the present invention is not limited to the above technical field. The technical field of the invention disclosed in this specification and the like relates to an object, a method, or a manufacturing method. Furthermore, one embodiment of the present invention relates to a process, a machine, manufacture, or a composition of matter.

In this specification and the like, a semiconductor device generally means a device that can function by utilizing semiconductor characteristics. In some cases, a display device, a light-emitting device, a memory device, an electro-optical device, a semiconductor circuit, and an electronic device include a semiconductor device.

BACKGROUND ART

Mobile industry processor interface (MIPI) standards, embedded DisplayPort (eDP), and other standards have been set for image data and control signals of display devices. In accordance with such a standard, communication is performed between a host (e.g., an application processor) and a timing controller (also called a display driver IC). Furthermore, panel self-refresh (PSR) technology has been proposed to reduce electric power required for communication.

A technique for using an oxide semiconductor transistor (hereinafter, referred to as an OS transistor) for a display device such as a liquid crystal display or an organic electroluminescence (EL) display has attracted attention. An OS transistor has an extremely low off-state current. In some disclosed techniques, by utilizing this fact, the refresh frequency at the time of displaying still images is reduced and power consumption of liquid crystal displays or organic EL displays is accordingly reduced (Patent Document 1 and Patent Document 2). Note that the aforementioned technique for reducing the power consumption of the display device is referred to as idling stop in this specification.

An example in which an OS transistor is used for a nonvolatile memory device has been disclosed in Patent Document 3, where the extremely low off-state current of the OS transistor is utilized.

REFERENCE

Patent Document

[Patent Document 1] Japanese Published Patent Application No. 2011-141522

[Patent Document 2] Japanese Published Patent Application No. 2011-141524

[Patent Document 3] Japanese Published Patent Application No. 2011-151383

DISCLOSURE OF INVENTION

To perform the above-mentioned idling stop, a dedicated circuit needs to be provided in a host that supplies a video signal. Accordingly, both a host and a panel need to be designed for idling stop to manufacture a display having an idling stop function.

An object of one embodiment of the present invention is to provide a display device that performs idling stop by a simple method and a method for operating the display device. Another object of one embodiment of the present invention is to provide a display device that performs idling stop at low costs and a method for operating the display device. Another object of one embodiment of the present invention is to provide a display device that is driven with low power consumption and a method for operating the display device. Another object of one embodiment of the present invention is to provide a novel semiconductor device.

Note that the description of a plurality of objects does not disturb the existence of each object. One embodiment of the present invention does not necessarily achieve all the objects. Objects other than those listed above are apparent from the description of the specification, drawings, claims, and the like and such objects could also be an object of one embodiment of the present invention.

One embodiment of the present invention is a display device that includes a host; a controller to which a first signal is supplied from the host; and a display panel to which a second signal is supplied from the controller. When the first signal includes image data, the first signal includes a command indicating the presence of the image data. When the controller detects the command, the controller supplies the image data as the second signal. When the controller does not detect the command, the controller stops supplying the second signal.

In the above embodiment, it is preferable that after the controller stops supplying the second signal for a predetermined time, the controller resume supplying the second signal regardless of whether or not the first signal includes the command.

In the above embodiment, the controller includes a frame memory, and the frame memory includes a transistor. The transistor preferably includes an oxide semiconductor in a channel formation region.

One embodiment of the present invention is a method for operating a display device that includes a host; a controller to which a first signal is supplied from the host; and a display panel to which a second signal is supplied from the controller. When the first signal includes image data, the first signal includes a command indicating the presence of the image data. When the controller detects the command, the controller supplies the image data as the second signal. When the controller does not detect the command, the controller stops supplying the second signal.

In the above embodiment, it is preferable that after the controller stops supplying the second signal for a predetermined time, the controller resume supplying the second signal regardless of whether or not the first signal includes the command.

In the above embodiment, the controller includes a frame memory, and the frame memory includes a transistor. The transistor preferably includes an oxide semiconductor in a channel formation region.

According to one embodiment of the present invention, a display device that performs idling stop by a simple method and a method for operating the display device can be provided. According to one embodiment of the present invention, a display device that performs idling stop at low costs and a method for operating the display device can be provided. According to one embodiment of the present invention, a display device that is driven with low power consumption and a method for operating the display device can be provided. According to one embodiment of the present invention, a novel semiconductor device can be provided.

Note that the description of these effects does not preclude the existence of other effects. One embodiment of the present invention does not necessarily achieve all the effects listed above. Other effects will be apparent from and can be derived from the description of the specification, the drawings, the claims, and the like.

BEST MODE FOR CARRYING OUT THE INVENTION

Figure 1:
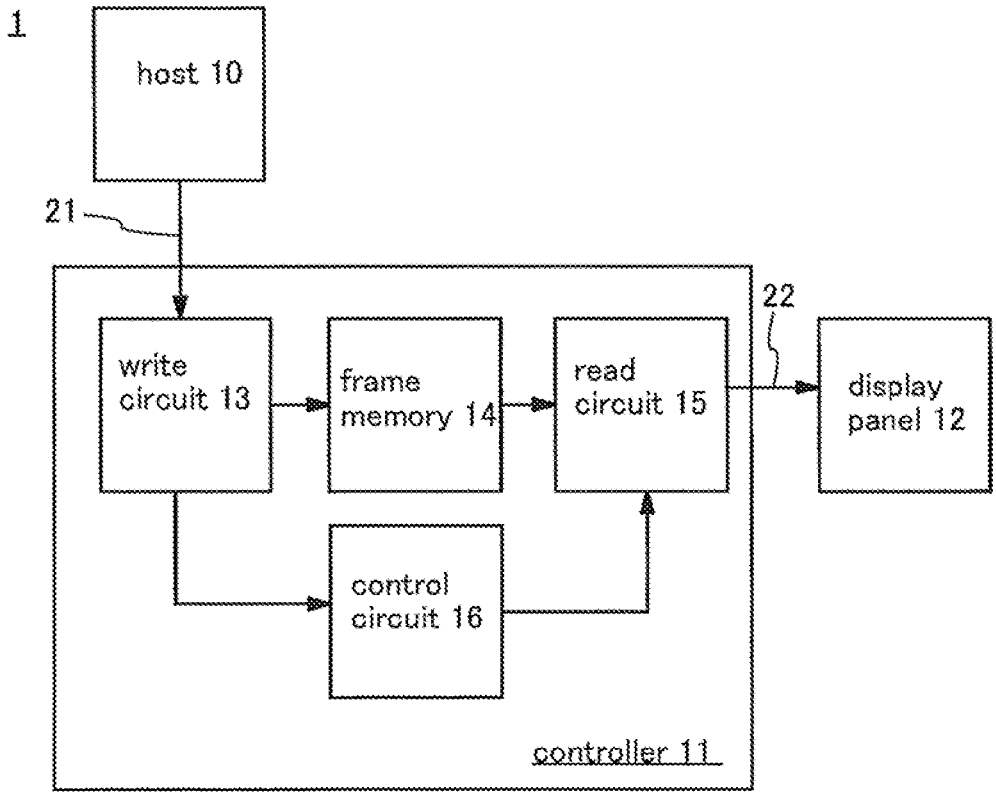
FIG. 1 is a block diagram illustrating a configuration example of a display device.

Hereinafter, embodiments will be described with reference to drawings. It will be readily appreciated by those skilled in the art that modes and details can be changed in various ways without departing from the spirit and scope of the present invention. Thus, the present invention should not be interpreted as being limited to the following description of the embodiments.

In the drawings, the size, the layer thickness, or the region is exaggerated for clarity in some cases. Therefore, the size, the layer thickness, or the region is not limited to the illustrated scale. Note that the drawings are schematic views showing ideal examples, and embodiments of the present invention are not limited to shapes or values shown in the drawings.

Note that in this specification, a high power supply voltage and a low power supply voltage are sometimes referred to as an H level (or $V_{DD}$) and an L level (or GND), respectively.

Furthermore, in the present specification, any of the embodiments described below can be combined as appropriate. In addition, in the case where a plurality of structure examples are described in one embodiment, some of the structure examples can be combined as appropriate.

(Embodiment 1)

In this embodiment, a display device of one embodiment of the present invention will be described.

<Configuration Example 1 of Display Device>

FIG. 1 is a block diagram illustrating a configuration example of a display device 1. The display device 1 includes a host 10, a controller 11, and a display panel 12. The controller 11 includes a write circuit 13, a frame memory 14, a read circuit 15, and a control circuit 16. Note that the write circuit 13, the read circuit 15, and the control circuit 16 are closely related and there is sometimes no clear boundary between the circuits.

The host 10 includes a central processing unit (CPU) and has a function of supplying a signal 21 to the controller 11. The signal 21 is a video signal and includes image data that is to be displayed by the display panel 12.

The signal 21 is transmitted in a packet format. When the packet includes image data, the signal 21 has a specific format or a specific command. For example, in the case where the signal 21 conforms to a MIPI standard, examples of such a format and a command include packed pixel stream of Display Serial Interface (DSI) and write_memory_start of Display Command Set (DCS). Note that a general term "write command" is used to refer to such a format or a command in the present specification.

The write circuit 13 has a function of writing, into the frame memory 14, image data received from the host 10. In addition, the write circuit 13 has a function of decoding the write command included in the signal 21.

The frame memory 14 is a memory for storing the image data that is supplied from the host 10.

The read circuit 15 has a function of reading image data from the frame memory 14. The read image data is supplied to the display panel 12 as a signal 22.

The read circuit 15 has a function of controlling the display panel 12. Specifically, the read circuit 15 outputs a clock signal or a start pulse signal to control the display panel 12.

The control circuit 16 has a function of controlling idling stop of the display device 1. Specifically, the control circuit 16 detects the write command that is decoded by the write circuit 13, and determines operation of the read circuit 15. When not detecting a write command, the control circuit 16 determines that the signal 21 is not supplied or the signal 21 does not include image data, and stops operation of the read circuit 15. In that case, supply of the signal 22 is stopped. That is, the display device 1 goes into an idling stop state.

The display panel 12 includes a plurality of pixels and has a function of displaying the image data included in the signal 22. The display panel 12 can display image data by control of emission/non-emission of the pixel. For the pixel, a liquid crystal element or an EL element (note that the EL element includes one or both of an organic compound and an inorganic compound) can be used, for example.

The pixel can include, in addition to them, at least one of an LED chip (e.g., a white LED chip, a red LED chip, a green LED chip, or a blue LED chip), a transistor (a transistor that emits light depending on current), an electron emitter, a display element including a carbon nanotube, electronic ink, an electrowetting element, an electrophoretic element, a display element using micro electro mechanical systems (MEMS) (such as a grating light valve (GLV), a digital micromirror device (DMD), a digital micro shutter (DMS), MIRASOL (registered trademark), an interferometric modulator display (IMOD) element, a MEMS shutter display element, an optical-interference-type MEMS display element, or a piezoelectric ceramic display element), quantum dots, and the like.

<Configuration Example 2 of Display Device>

Figure 2:
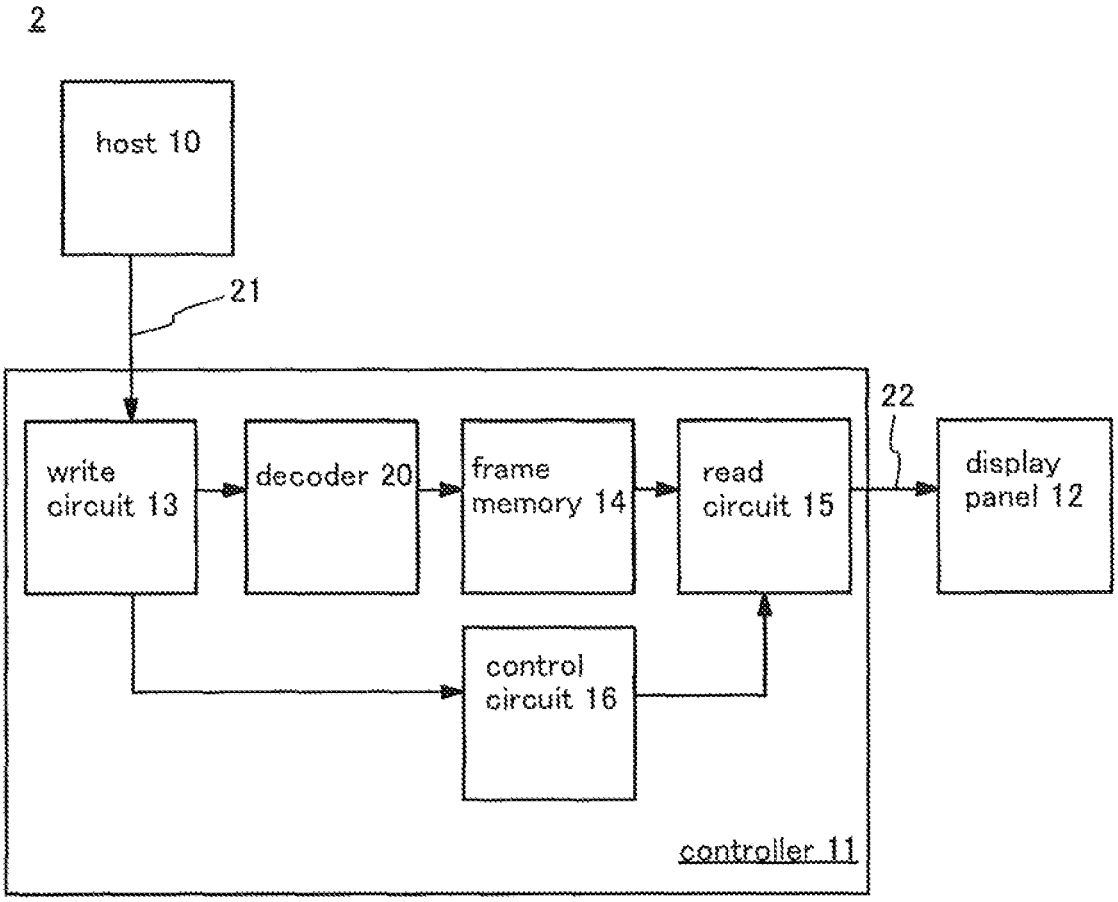
FIG. 2 is a block diagram illustrating a configuration example of a display device.
Figure 3:
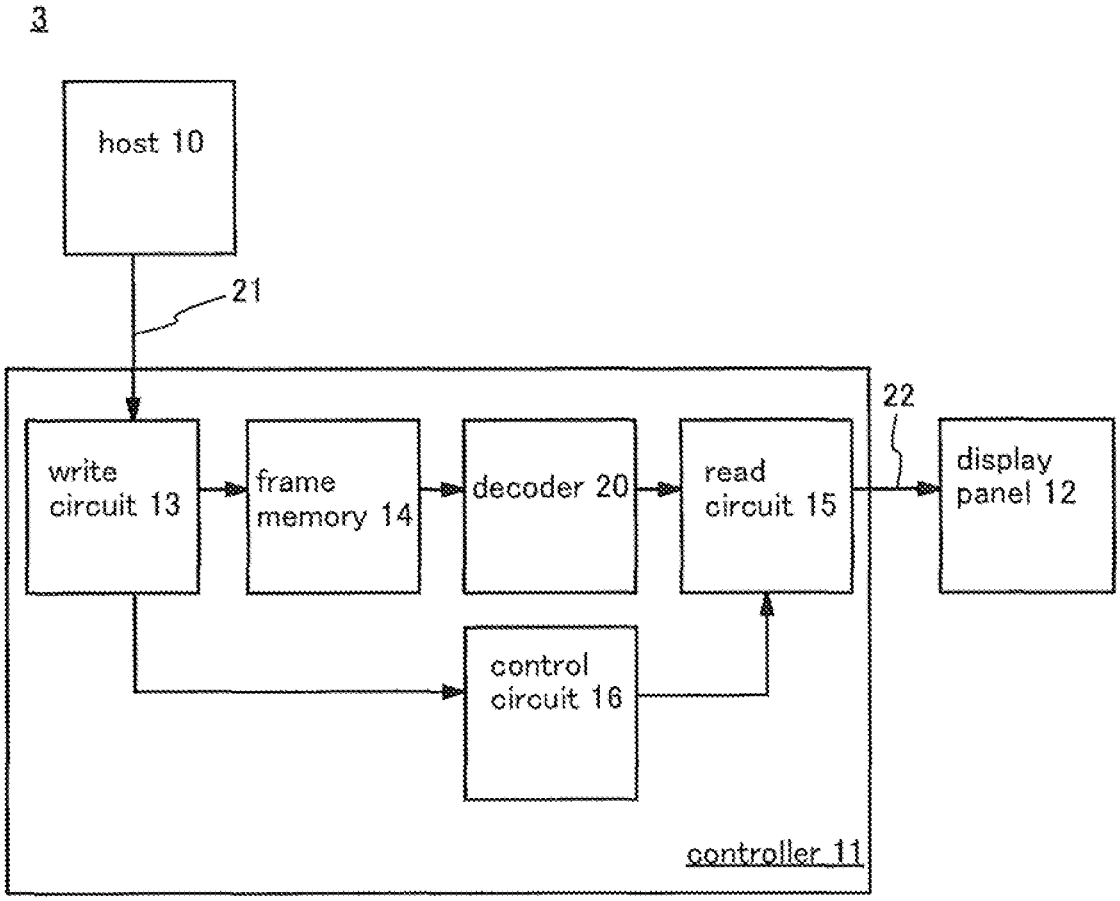
FIG. 3 is a block diagram illustrating a configuration example of a display device.

The signal 21 supplied from the host 10 includes compressed image data in some cases. In that case, the controller 11 preferably includes a decoder. FIG. 2 and FIG. 3 each illustrate a configuration example of such a case.

A display device 2 illustrated in FIG. 2 is different from the above display device 1 in that a decoder 20 is provided between the write circuit 13 and the frame memory 14. The decoder 20 has a function of decompressing compressed image data.

The time it takes for the decoder 20 to decompress image data is long in many cases although it depends on the size of the image data. In the display device 2, the image data stored in the frame memory 14 can be read by the read circuit 15 without passing through the decoder 20. Thus, once image data is stored in the frame memory 14, an image can be displayed by the display panel 12 in a short time.

<Configuration Example 3 of Display Device>

A display device 3 illustrated in FIG. 3 is different from the above display devices 1 and 2 in that the decoder 20 is provided between the frame memory 14 and the read circuit 15.

When image data has a large size, it is preferable that the frame memory 14 that stores the image data have a large memory capacity. However, a memory with a large capacity is expensive and increases the cost of the whole display device. In the display device 3, image data in a compressed state can be stored in the frame memory 14, so that the memory capacity of the frame memory 14 can be saved and the cost of the whole display device can be reduced.

<Operation Example 1 of Display Device>

Next, an operation example of the above-described display device will be described. Unless otherwise specified, the signal 21 conforms to a MIPI standard in the following description.

Figure 4:
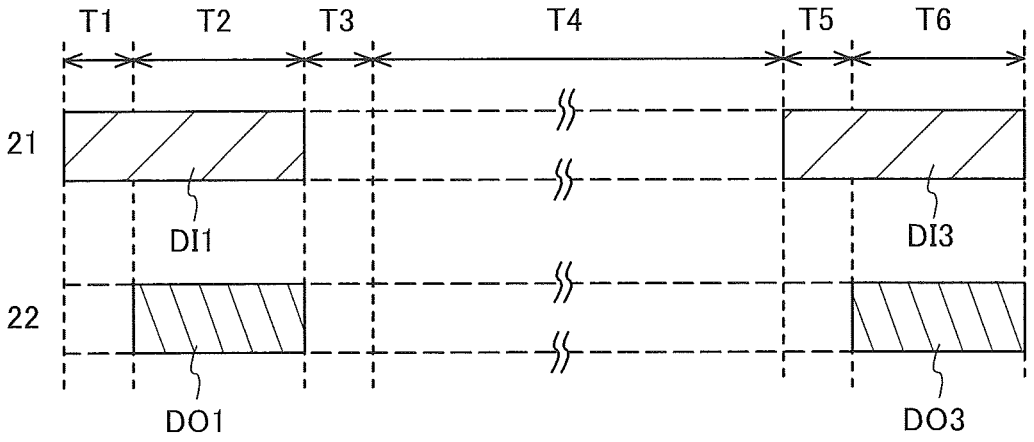
FIG. 4 is a timing chart illustrating an operation example of a display device.

FIG. 4 is a timing chart illustrating the signal 21 and the signal 22. The timing chart in FIG. 4 is divided into periods T1 to T6 to illustrate the timing of operation.

Each of the periods T1, T3, and T5 is a retrace period of a video signal, and each of the periods T2 and T6 is one frame period of a video signal. The period T4 is a period in which the display device is in an idling stop state.

In the period T1, a signal DI1 is transmitted from the host 10 to the controller 11. The control circuit 16 detects a write command included in the signal DI1. The control circuit 16 keeps receiving the signal DI1 until the end of the period T2 and finds out that image data in the frame memory 14 has been updated.

In the period T2, the image data written into the frame memory 14 is transmitted to the display panel 12 as a signal DO1, whereby an image on the display panel 12 is updated.

In the period T3, the signal 21 does not include image data. In other words, the control circuit 16 does not detect a write command. The control circuit 16 finds out that the image data in the frame memory 14 is not updated. The control circuit 16 stops operation of the read circuit 15 (idling stop). The operation of the read circuit 15 is stopped until the end of the period T4.

In the period T5, a signal DI3 is transmitted from the host 10 to the controller 11. The control circuit 16 detects a write command included in the signal DI3 and resets the stop of the operation of the read circuit 15. The control circuit 16 keeps receiving the signal DI3 until the end of the period T6 and finds out that the image data in the frame memory 14 has been updated.

In the period T6, the image data written into the frame memory 14 is transmitted to the display panel 12 as a signal DO3, whereby the image on the display panel 12 is updated.

Figure 25:
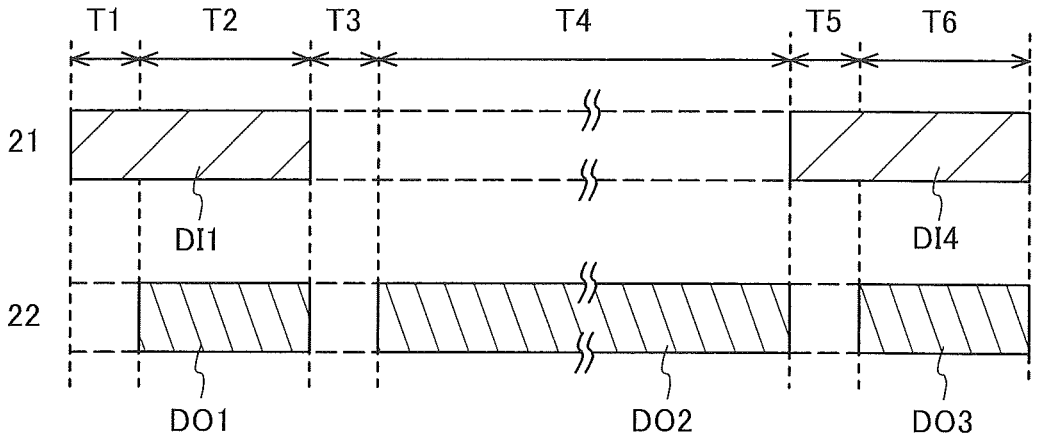
FIG. 25 is a timing chart illustrating an operation example of a display device.

For comparison, a timing chart (FIG. 25) of the case where the display device does not have an idling stop function is considered. FIG. 25 is different from FIG. 4 in that a signal DO2 is supplied in the period T4. Although the signal DO2 appears to be one frame in the chart, the signal DO2 is actually collection of frames.

In a display device without an idling stop function, an image on the display panel 12 needs to keep being updated even when supply of the signal 21 is suspended; therefore, image data stored in the frame memory 14 needs to be read at regular intervals to keep being supplied to the display panel. Consequently, the power consumption of the display device increases.

In the display device of one embodiment of the present invention, when supply of the signal 21 is stopped, operation of the read circuit 15 is stopped and supply of the signal 22 is also stopped as illustrated in FIG. 4. Consequently, the display device can consume less power.

In the display device of one embodiment of the present invention, the host 10 does not need to include a circuit dedicated to idling stop, so that idling stop can be performed by a simple method.

In another method for performing idling stop, a frame is observed in the controller 11 for a given time, and if there is no change, idling stop is performed. This method requires a large-scale image processing circuit in the controller 11 and thus increases the manufacturing cost of the controller 11.

In the display device of one embodiment of the present invention, the controller 11 does not need to be provided with such a large-scale circuit and it is thus possible to manufacture the controller 11 at low costs.

<Operation Example 2 of Display Device>

When the display panel 12 is a liquid crystal panel, continuous application of a given potential to the liquid crystal by idling stop causes image burn-in on the liquid crystal panel. To prevent such image burn-in, the potential applied to the liquid crystal is preferably inverted at intervals of approximately one minute. It is thus preferable that the control circuit 16 include a timer and have a function of resetting idling stop after idling stop continues for a predetermined time (e.g., one minute). A timing chart of this case is shown in FIG. 5.

Figure 5:
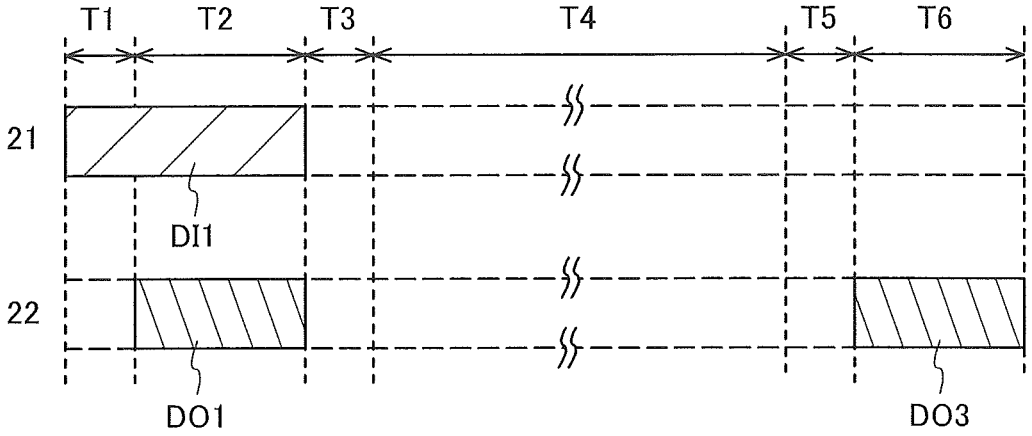
FIG. 5 is a timing chart illustrating an operation example of a display device.

The period T4 in the timing chart in FIG. 5 is a period in which operation of the read circuit 15 is stopped. After a predetermined time passes as the period T4, the control circuit 16 resets the stop of operation of the read circuit 15. Even when a write command is not detected from the signal 21 in the period T5, the read circuit 15 reads the image data that is stored in the frame memory 14 in the period T2 and transmits the image data as the signal DO3.

In the case where the display device operates in accordance with the timing chart in FIG. 5, the decoder 20 is preferably provided between the write circuit 13 and the frame memory 14 as in the display device 2 illustrated in FIG. 2. In this manner, the read circuit 15 can read image data from the frame memory 14 in a short time.

<Operation Example 3 of Display Device>

Figure 6:
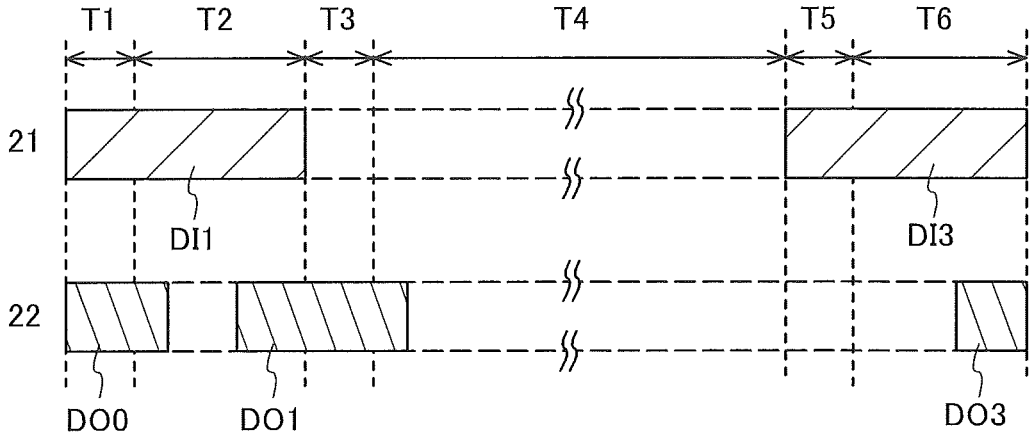
FIG. 6 is a timing chart illustrating an operation example of a display device.

The case where writing and reading of data into and from the frame memory 14 are performed in one frame period has been described with reference to FIG. 4 and FIG. 5. Next, the case where data writing and data reading extend over a plurality of frame periods is described. A timing chart of this case is shown in FIG. 6.

First, the control circuit 16 detects a write command included in the signal DI1 in the period T1. Then, in the period T2, writing of the signal DI1 into the frame memory 14 starts. After a while after the wiring starts, the signal DO1 is output.

In the period T3, the control circuit 16 does not detect a write command. In the period T4, the control circuit 16 stops the operation of the read circuit 15 after the output of the signal DO1 ends.

Next, in the period T5, the control circuit 16 detects a write command included in the signal DI3 and resets the stop of the read circuit 15.

<Configuration Example of Packet>

Figure 7:
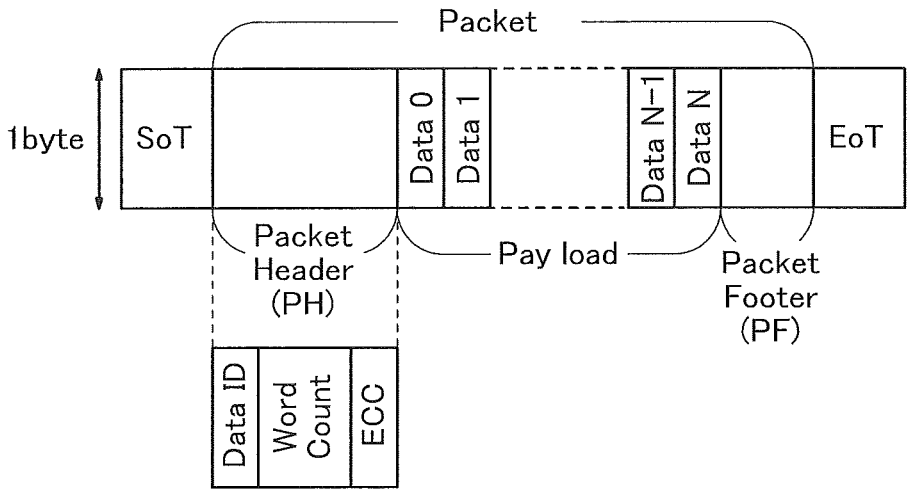
FIG. 7 illustrates an example of a video signal.

FIG. 7 illustrates an example of a packet format of the signal 21 (the case of a long packet format).

A packet is transferred between start of transmission (SoT) and end of transmission (EoT) and has a header area (a packet header) and a footer area (a packet footer).

Payload is a data area of a packet and includes the number of pixel gray levels, commands, information on pixel coordinate, or the like.

The header area includes data ID, the number of transferred data (a word count), and an error-correcting code (ECC).

The data ID includes a virtual channel identifier and information on the data type of the payload.

The above-mentioned write_memory_start is included in the payload. The above-mentioned packed pixel stream is included in the data ID.

<Frame Memory>

A configuration of a memory cell that can be used for the frame memory 14 is described with reference to FIG. 8, FIGS. 9A and 9B, FIG. 10, and FIGS. 11A and 11B.

It is preferable that the frame memory 14 can perform writing and reading of image data at the same time. Two examples of the memory that can be used as the frame memory 14 are a dual-port memory and a single-port memory.

In this specification, a dual-port memory means a memory that performs data input and data output with a plurality of interfaces. The number of the interfaces is not limited to two and may be three or more. Since a dual-port memory has a plurality of interfaces, it can perform data writing and data reading at the same time.

In this specification, a single-port memory means a memory that performs data input and data output with a single interface. A single-port memory performs data writing and data reading at different timings. Note that a single-port memory can also perform data writing and data reading at the same time by utilizing double buffering technique or the like. A single-port memory includes a smaller number of wirings and transistors than a dual-port memory, so that the area occupied by a memory cell can be reduced.

First, an example of a dual-port memory is described.

<<Configuration Example 1 of Memory Cell>>

Figure 8:
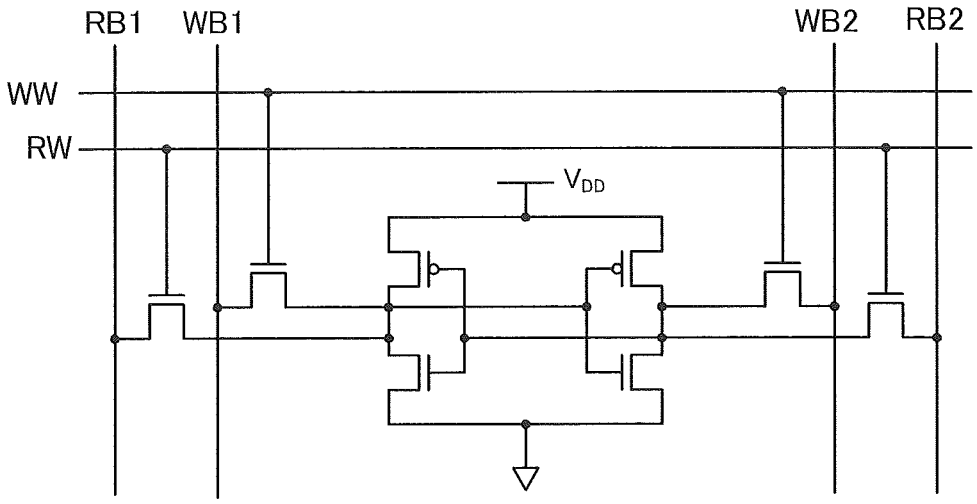
FIG. 8 is a circuit diagram illustrating a configuration example of a memory cell.

FIG. 8 is a circuit diagram of a memory cell 31 that can be used for the frame memory 14. The memory cell 31 is a typical static random access memory (SRAM). The memory cell 31 can include a transistor (a Si transistor) that includes Si in a channel formation region.

The memory cell 31 includes a wiring WW, a wiring RW, a wiring RB1, a wiring RB2, a wiring WB1, and a wiring WB2.

The wiring WW has a function of a word line for data writing, and the wiring RW has a function of a word line for data reading. The wirings WB1 and WB2 each have a function of a bit line for data writing. The wirings RB1 and RB2 each have a function of a bit line for data reading.

Separate wirings are provided as the bit line for data writing and the bit line for data reading in the memory cell 31. Accordingly, a frame memory using the memory cell 31 is a dual-port memory.

<<Configuration Example 2 of Memory Cell>>

Figure 9A:
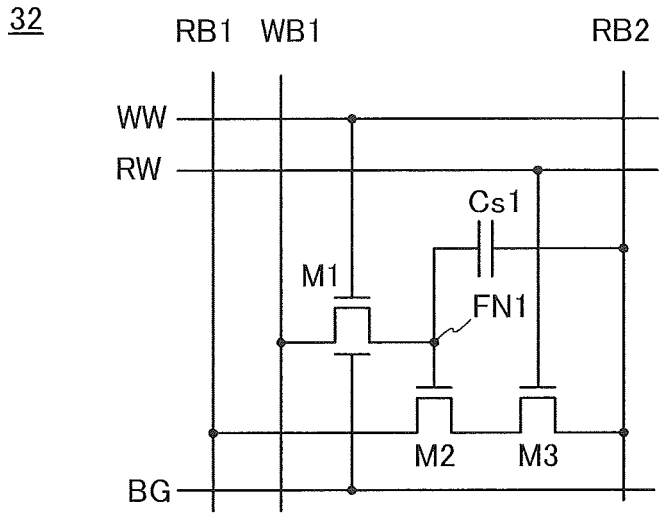
FIGS. 9A and 9B are circuit diagrams each illustrating a configuration example of a memory cell.

FIG. 9A is a circuit diagram of a memory cell 32 that can be used for the frame memory 14. The memory cell 32 includes a transistor M1, a transistor M2, a transistor M3, and a capacitor Cs1. The memory cell 32 is electrically connected to the wiring WW, the wiring RW, a wiring BG, the wiring RB1, the wiring WB1, and the wiring RB2.

The wiring WW has a function of a word line for data writing, and the wiring RW has a function of a word line for data reading. The wiring WB1 has a function of a bit line for data writing. The wirings RB1 and RB2 each have a function of a bit line for data reading.

The transistor M1 includes a first gate and a second gate. The first gate is electrically connected to the wiring WW and the second gate is electrically connected to the wiring BG. The first gate and the second gate preferably have regions overlapping with each other with a channel formation region positioned therebetween.

The transistor M1 preferably has a low current (off-state current) flowing between a source and a drain in an off state. Here, the term "low off-state current" means that a normalized off-state current per micrometer of channel width with a voltage between a source and a drain set at 1.8 V is $1\times10^{-20}$ A or lower at room temperature, $1\times10^{-18}$ A or lower at 85° C., or $1\times10^{-16}$ A or lower at 125° C. An example of a transistor with such a low off-state current is an OS transistor.

Examples of oxide semiconductors that can be used for the above OS transistor include an In—Ga oxide, an In—Zn oxide, and an In-M-Zn oxide (M is Ti, Ga, Y, Zr, La, Ce, Nd, Sn, or Hf). Note that the oxide semiconductor is not limited to an oxide containing In. The oxide semiconductor may be, for example, a Zn oxide, a Zn—Sn oxide, or a Ga—Sn oxide.

Si transistors or OS transistors are preferably used as the transistors M2 and M3.

Next, operation of the memory cell 32 is described. Note that an L level potential is applied to the wiring RB2 during the operation.

First, the wiring WW is set at an H level to turn on the transistor M1. Data is written from the wiring WB1 into a node FN1 (a gate of the transistor M2) through the transistor M1.

Then, the wiring WW is set at an L level to turn off the transistor M1. Since the transistor M1 has a low off-state current, the data written into the node FN1 is retained for a long period of time.

Next, the wiring RB1 is set at an H level and then, the wiring RB1 is brought into an electrically floating state.

Next, an H level potential is applied to the wiring RW to turn on the transistor M3. Here, in the case where "1" has been written into the node FN1, the transistor M2 is turned on, so that a current flows between the wiring RB1 and the wiring RB2. In the case where "0" has been written into the node FN1, the transistor M2 is turned off, so that a current does not flow between the wiring RB1 and the wiring RB2. Finally, a change in potential of the wiring RB1 is read, whereby the data written into the node FN can be read.

A predetermined potential $V_{BG}$ is preferably applied to the wiring BG. It is particularly preferable that a negative potential be applied as the potential $V_{BG}$. When a negative potential is applied to the second gate of the transistor M1, the transistor M1 can be prevented from being normally on. Note that the second gate of the transistor M1 and the wiring BG need not be provided in some cases.

<<Configuration Example 3 of Memory Cell>>

Figure 9B:
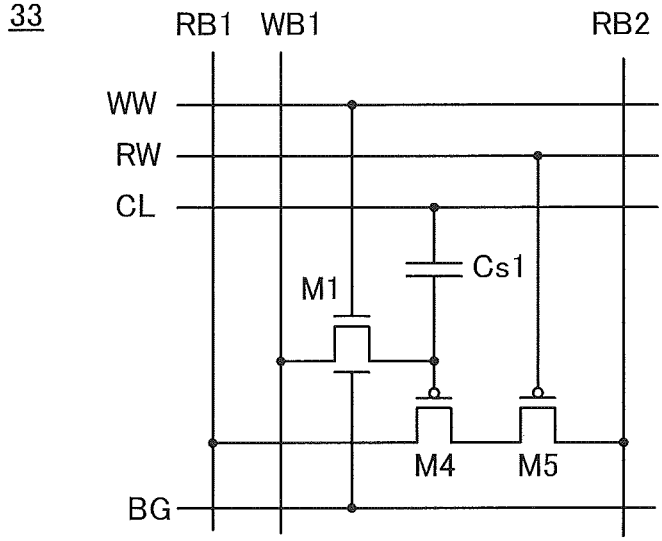

FIG. 9B is a circuit diagram of a memory cell 33 that can be used for the frame memory 14. The memory cell 33 is different from the memory cell 32 in that p-channel transistors, a transistor M4 and a transistor M5, are provided instead of the transistors M2 and M3 and that the capacitor Cs1 is electrically connected to a wiring CL. An L level potential is constantly applied to the wiring CL.

Separate wirings are provided as the bit line for data writing and the bit line for data reading in each of the memory cells 32 and 33 as in the memory cell 31. Accordingly, a frame memory using the memory cell 32 or the memory cell 33 is a dual-port memory.

The memory cell 31 is a volatile memory and thus, its data is lost when the power is turned off. In contrast, the memory cells 32 and 33 are nonvolatile and their data is not lost even after the power is turned off. As a result, the frame memory can save electric power. Specifically, the power can be turned off in the period T3 and the period T4 in FIG. 4, the period T3, the period T4, and the period T5 in FIG. 5, and the period T4 in FIG. 6.

Next, the case where the frame memory 14 is a single-port memory is described.

<<Configuration Example 4 of Memory Cell>>

Figure 10:
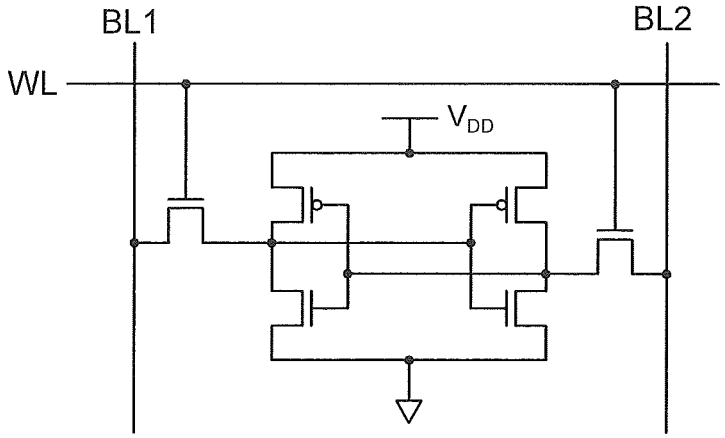
FIG. 10 is a circuit diagram illustrating a configuration example of a memory cell.

FIG. 10 is a circuit diagram of a memory cell 34 that can be used for the frame memory 14. The circuit diagram of the memory cell 34 is obtained when a common bit line is used as the bit line for data writing and the bit line for data reading that are included in the memory cell 31 shown in FIG. 8.

A wiring WL has a function of a word line for data reading and data writing. A wiring BL1 has a function of a bit line for data reading and data writing. Similarly, a wiring BL2 has a function of a bit line for data reading and data writing.

The memory cell 34 has a smaller number of wirings and a smaller number of transistors than the memory cell 31. Thus, the memory cell occupies a smaller area and a memory cell array having a high degree of integration can be built.

<<Configuration Example 5 of Memory Cell>>

Figure 11A:
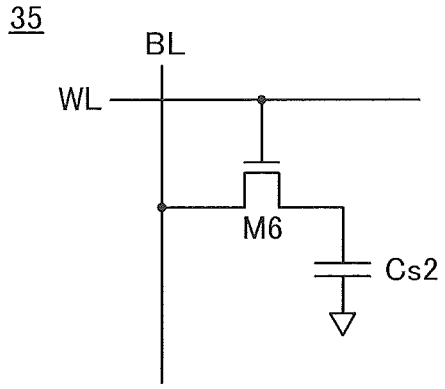
FIGS. 11A and 11B are circuit diagrams each illustrating a configuration example of a memory cell.

FIG. 11A is a circuit diagram of a memory cell 35 that can be used for the frame memory 14. The memory cell 35 includes a transistor M6 and a capacitor Cs2. The memory cell 35 is electrically connected to a wiring BL and the wiring WL.

The memory cell 35 is a typical dynamic random access memory (DRAM). A transistor (a Si transistor) containing silicon in a channel formation region can be used as the transistor M6.

The memory cell 35 has a smaller number of transistors than the memory cells 31 to 34. Thus, the memory cell occupies a smaller area and a frame memory having a high degree of integration can be built.

<<Configuration Example 6 of Memory Cell>>

Figure 11B:
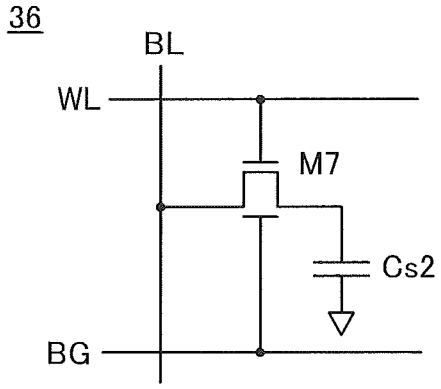

In the memory cell 35, an OS transistor may be used as the transistor M6. FIG. 11B is a circuit diagram of that case.

FIG. 11B is a circuit diagram of a memory cell 36 that can be used for the frame memory 14. The memory cell 36 includes a transistor M7 and the capacitor Cs2. The transistor M7 is preferably an OS transistor like the transistor M1 shown in FIGS. 9A and 9B. When an OS transistor is used as the transistor M7, the data written into the capacitor Cs2 can be retained for a long period of time in the memory cell 36.

The transistor M7 includes a first gate and a second gate. The first gate is electrically connected to the wiring WL and the second gate is electrically connected to the wiring BG. The first gate and the second gate preferably have regions overlapping with each other with a channel formation region positioned therebetween.

The predetermined potential $V_{BG}$ is preferably applied to the wiring BG. It is particularly preferable that a negative potential be applied as the potential $V_{BG}$. When a negative potential is applied to the second gate of the transistor M7, the transistor M7 can be prevented from being normally on. Note that the second gate of the transistor M7 and the wiring BG need not be provided in some cases.

The memory cell 35 is a volatile memory and thus, its data is lost when the power is turned off. In contrast, the memory cell 36 is nonvolatile and its data is not lost even after the power is turned off. As a result, the frame memory can save electric power. Specifically, the power can be turned off in the period T3 and the period T4 in FIG. 4, the period T3, the period T4, and the period T5 in FIG. 5, and the period T4 in FIG. 6.

As described above, idling stop can be performed by a simple method with the use of the display device described in this embodiment and the method for operating the display device. In addition, idling stop can be performed at low costs. Furthermore, a display device that is driven with low power consumption and a method for operating the display device can be provided.

(Embodiment 2)

In this embodiment, a display device of one embodiment of the present invention will be described.

<Configuration Example of Display Device>

Figure 12A:
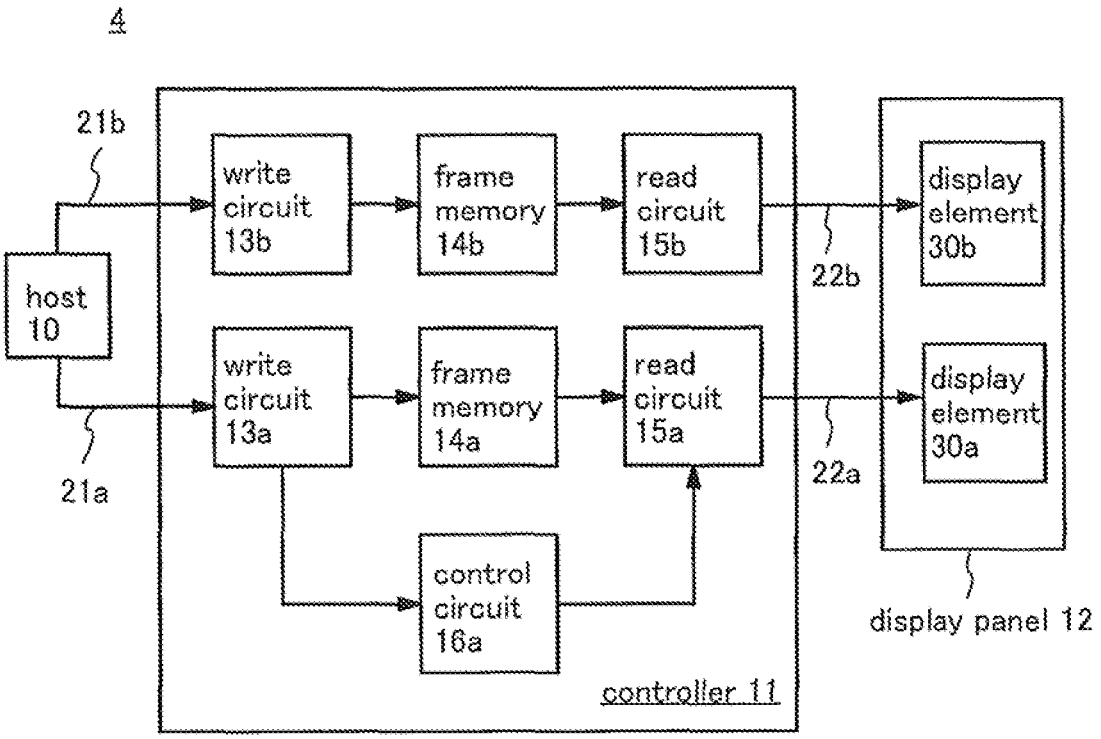
FIG. 12A is a block diagram illustrating a configuration example of a display device and FIG. 12B is a timing chart illustrating an operation example of a display device.
Figure 12B:
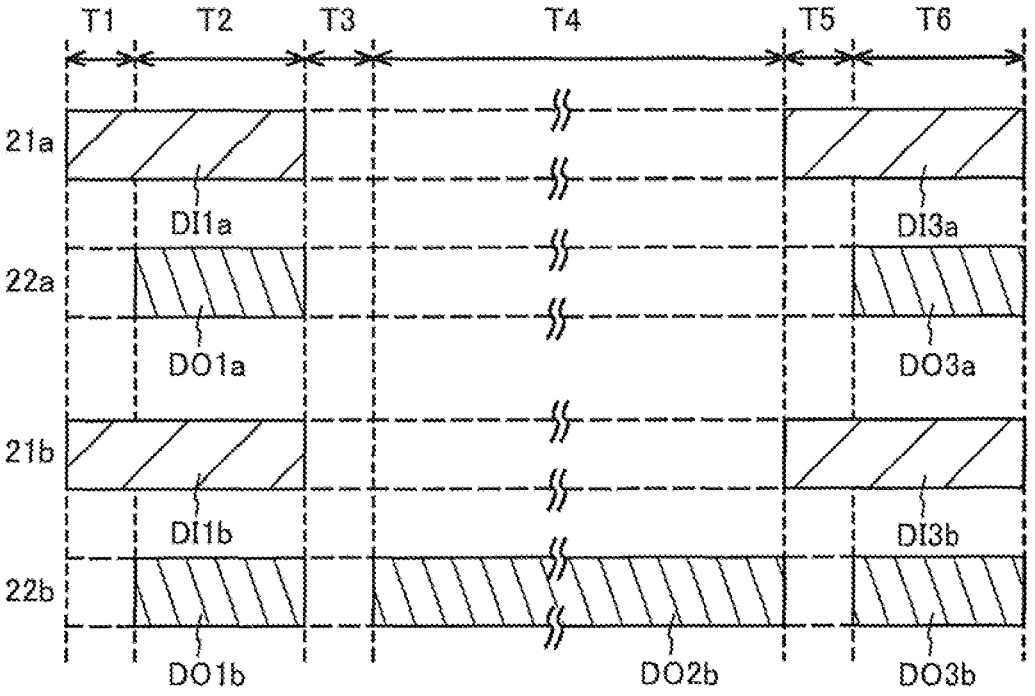

FIG. 12A is a block diagram illustrating a configuration example of a display device 4, and FIG. 12B is a timing chart illustrating an example of operation of the display device 4.

The display device 4 includes the host 10, the controller 11, and the display panel 12. The controller 11 includes write circuits 13*a* and 13*b*, frame memories 14*a* and 14*b*, read circuits 15*a* and 15*b*, and a control circuit 16*a*.

The display panel 12 includes two display elements: a display element 30*a* and a display element 30*b*. The display element 30*a* is subjected to idling stop and the display element 30*b* is not.

The write circuits 13*a* and 13*b* each correspond to the write circuit 13 shown in FIG. 1, the frame memories 14*a* and 14*b* each correspond to the frame memory 14 shown in FIG. 1, the read circuits 15*a* and 15*b* each correspond to the read circuit 15 shown in FIG. 1, and the control circuit 16*a* corresponds to the control circuit 16 shown in FIG. 1. For details of other components of the display device 4, the description of FIG. 1 can be referred to.

The host 10 supplies a signal 21*a* and a signal 21*b* to the controller 11. The signal 21*a* is a video signal and includes image data that is to be displayed by the display element 30*a*. Similarly, the signal 21*b* is a video signal and includes image data that is to be displayed by the display element 30*b*.

In a manner similar to that of the signal 21 shown in FIG. 1, the signals 21*a* and 21*b* are transmitted in a packet format. When the packet includes image data, the signals 21*a* and 21*b* include the write command described in Embodiment 1.

The write circuit 13*a* has a function of writing, into the frame memory 14*a*, the image data included in the signal 21*a*. The read circuit 15*a* has a function of reading the image data written into the frame memory 14*a* and supplying the image data to the display panel 12 as a signal 22*a*.

The write circuit 13*b* has a function of writing the image data included in the signal 21*b* into the frame memory 14*b*. The read circuit 15*b* has a function of reading the image data written into the frame memory 14*b* and supplying the image data to the display panel 12 as a signal 22*b*.

The control circuit 16*a* detects the write command that is decoded by the write circuit 13*a*, and determines operation of the read circuit 15*a*. When not detecting a write command, the control circuit 16*a* determines that the signal 21*a* is not supplied or the signal 21*a* does not include image data, and stops operation of the read circuit 15*a*. In that case, supply of the signal 22*a* is stopped. That is, the display device 4 goes into an idling stop state.

<Operation Example of Display Device>

Next, operation of the display device 4 is described with reference to the timing chart in FIG. 12B. Note that in the following description, the signals 21*a* and 21*b* conform to a MIPI standard like the signal 21.

In the period T1, a signal DI1*a* and a signal DI1*b* are transmitted from the host 10 to the controller 11. The control circuit 16*a* detects a write command included in the signal DI1*a*. The control circuit 16*a* keeps receiving the signal DI1*a* until the end of the period T2 and finds out that image data in the frame memory 14*a* has been updated.

In the period T2, the image data written into the frame memory 14*a* is transmitted to the display panel 12 as a signal DO1*a*, whereby the image displayed by the display element 30*a* is updated. In a similar manner, the image data written into the frame memory 14*b* is transmitted to the display panel 12 as a signal DO1*b*, whereby the image displayed by the display element 30*b* is updated.

In the period T3, the signal 21*a* does not include image data. In other words, the control circuit 16*a* does not detect a write command. The control circuit 16*a* finds out that the image data in the frame memory 14*a* is not updated. The control circuit 16*a* stops operation of the read circuit 15*a*. The operation of the read circuit 15*a* is stopped until the end of the period T4. Note that the power of the frame memory 14*a* is preferably turned off in the period T3 and the period T4.

In the period T3, the signal 21*b* does not include image data. In the period T4, the read circuit 15*b* reads the image data that is written in the period T2 from the frame memory 14*b*, and transmits the image data to the display panel 12 as a signal DO2*b*. Although the signal DO2*b* appears to be one frame in the chart, the signal DO2*b* is actually collection of frames.

In the period T5, a signal DI3*a* and a signal DI3*b* are transmitted from the host 10 to the controller 11. The control circuit 16*a* detects a write command included in the signal DI3*a* and resets the stop of the operation of the read circuit 15*a*. The control circuit 16*a* keeps receiving the signal DI3*a* until the end of the period T6 and finds out that the image data in the frame memory 14*a* has been updated.

In the period T6, the image data written into the frame memory 14*a* is transmitted to the display panel 12 as a signal DO3*a*, whereby the image displayed by the display element 30*a* is updated. In a similar manner, the image data written into the frame memory 14*b* is transmitted to the display panel 12 as a signal DO3*b*, whereby the image displayed by the display element 30*b* is updated.

Note that the control circuit 16*a* may reset the stop of operation of the read circuit 15*a* before detecting a write command after operation of the read circuit 15*a* is stopped for a predetermined time (e.g., one minute) as illustrated in the timing chart in FIG. 5.

The display device 4 illustrated in FIG. 12A need not be provided with the frame memory 14*b* in some cases. In their words, the signal 21*b* input to the controller 11 may be as it is when being output as the signal 22*b*.

In the display device 4 illustrated in FIG. 12A, a decoder may be provided between the write circuit 13*a* and the frame memory 14*a*, between the frame memory 14*a* and the read circuit 15*a*, between the write circuit 13*b* and the frame memory 14*b*, or between the frame memory 14*b* and the read circuit 15*b*. In the case where a decoder is provided between the write circuit 13*a* and the frame memory 14*a* or between the write circuit 13*b* and the frame memory 14*b*, the data in the frame memory can be read by the read circuit 15*a* or 15*b* in a short time without passing through a decoder, which is preferable. In the case where a decoder is provided between the frame memory 14*a* and the read circuit 15*a* or between the frame memory 14*b* and the read circuit 15*b*, the frame memory 14*a* or 14*b* needs a small memory capacity and the chip size of the controller 11 can be small, which is preferable.

As the display element 30*a*, a reflective display element is preferably used. The use of a reflective display element can reduce power consumption. In addition, an image with high contrast can be favorably displayed in an environment with bright external light. Specifically, a reflective liquid crystal element can be used as the display element 30*a*.

As the display element 30*b*, a light-emitting element is preferably used. With the use of a light-emitting element, an image can be favorably displayed in a dark environment. Specifically, an organic EL element, an inorganic EL element, a light-emitting diode, or the like can be used as the display element 30*b*.

In the display device 4, when the display element 30*a* and the display element 30*b* are collected in one pixel, two images generated with separate display elements can be overlapped and displayed as one image.

For example, when a background image and a text image are selected as the signal 21*a* and the signal 21*b*, respectively, and these images are displayed overlapping with each other, the display device 4 can used as a book (e.g., a literary book, a textbook, or a picture book). For a background image, image data is not updated so often; thus, idling stop can be easily used for a background image. Therefore, a book with low power consumption can be obtained.

Furthermore, the display device 4 can be in three display modes: display by the display element 30*a*, display by the display element 30*b*, and display by the display elements 30*a* and 30*b*. The display device 4 can select any of these display modes in accordance with the brightness of external light. As a result, the display device 4 makes it possible to provide a display device having excellent viewability.

As described above, the use of the display device in this embodiment makes it possible to provide a low-power display device.

(Embodiment 3)

In this embodiment, details of the display panel 12 described in Embodiment 2 are described.

<Configuration Example of Display Panel>

Figure 13:
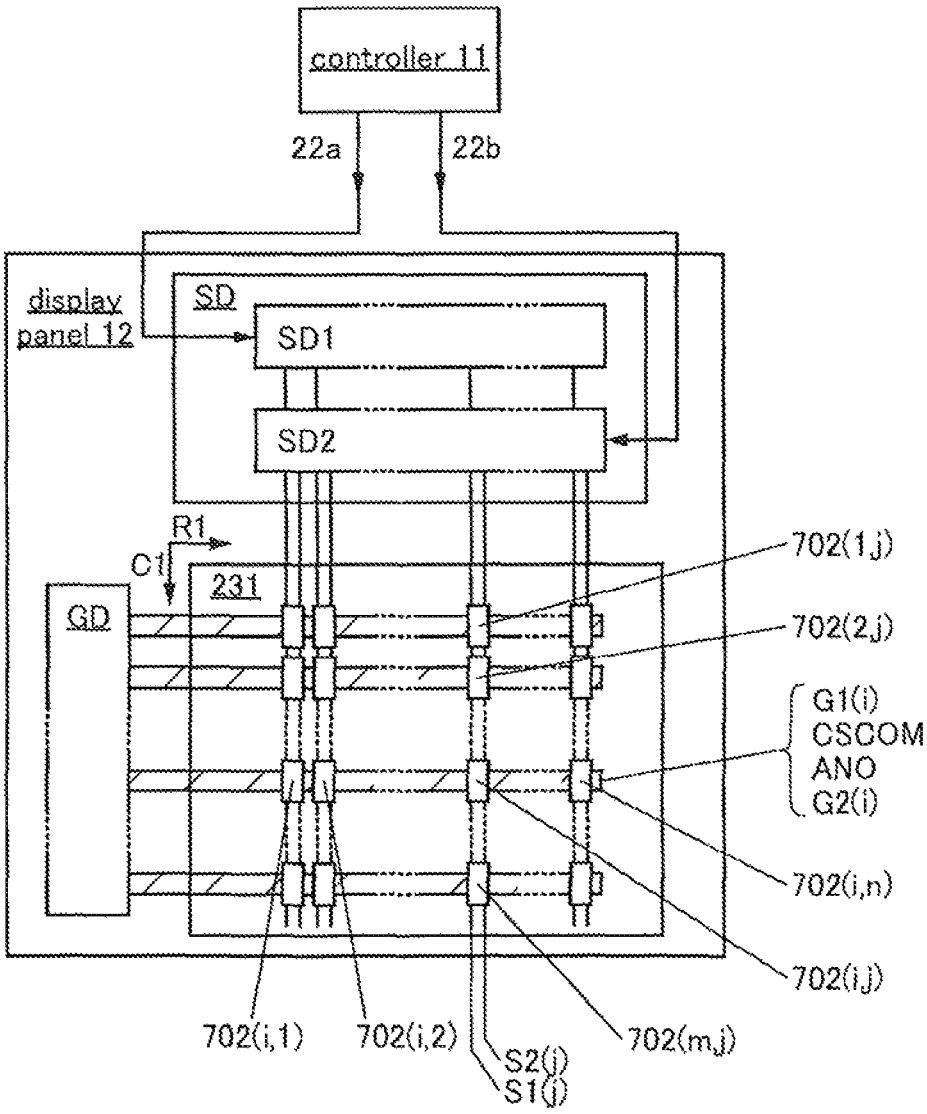
FIG. 13 is a block diagram illustrating a configuration example of a display panel.

FIG. 13 is a block diagram illustrating a configuration example of the display panel 12.

The display panel 12 includes a display region 231. The display panel 12 can include a driver circuit GD or a driver circuit SD.

<<Display Region 231>>

The display region 231 includes one group of pixels 702(i,1) to 702(i,n), another group of pixels 702(1,j) to 702(m,j), and a scan line G1(i). In addition, a scan line G2(i), a wiring CSCOM, a wiring ANO, and a signal line S2(j) are provided. Note that i is an integer greater than or equal to 1 and less than or equal to m, j is an integer greater than or equal to 1 and less than or equal to n, and each of m and n is an integer greater than or equal to 1.

The one group of pixels 702(i,1) to 702(i,n) include the pixel 702(i,j) and are provided in the row direction (the direction indicated by the arrow R1 in the drawing).

The another group of pixels 702(1,j) to 702(m,j) include the pixel 702(i,j) and are provided in the column direction (the direction indicated by the arrow C1 in the drawing) that intersects the row direction.

The scan line G1(i) and the scan line G2(i) are electrically connected to the one group of pixels 702(i,1) to 702(i,n) provided in the row direction.

The another group of pixels 702(1,j) to 702(m,j) provided in the column direction are electrically connected to a signal line S1(j) and the signal line S2(j).

<<Driver Circuit GD>>

The driver circuit GD has a function of supplying a selection signal in accordance with control data.

For example, the driver circuit GD has a function of supplying a selection signal to one scan line at a frequency of 30 Hz or higher, preferably 60 Hz or higher, in accordance with the control data. Accordingly, moving images can be smoothly displayed.

For example, the driver circuit GD has a function of supplying a selection signal to one scan line at a frequency lower than 30 Hz, preferably lower than 1 Hz, further preferably less than once per minute, in accordance with the control data. Accordingly, a still image can be displayed while flickering is suppressed.

<<Driver Circuit SD, Driver Circuit SD1, Driver Circuit SD2>>

The driver circuit SD includes a driver circuit SD1 and a driver circuit SD2. The driver circuit SD1 has a function of supplying an image signal in accordance with the signal 22*a*. The driver circuit SD2 has a function of supplying an image signal in accordance with the signal 22*b*.

The driver circuit SD1 has a function of generating an image signal that is to be supplied to a pixel circuit electrically connected to one display element. Specifically, the driver circuit SD1 has a function of generating a signal whose polarity is inverted. With this configuration, for example, a liquid crystal display element can be driven.

The driver circuit SD2 has a function of generating an image signal that is supplied to a pixel circuit electrically connected to another display element which displays an image by a method different from that of the one display element. With this configuration, for example, an organic EL element can be driven.

For example, a variety of sequential circuits, such as a shift register, can be used for the driver circuit SD.

For example, an integrated circuit in which the driver circuit SD1 and the driver circuit SD2 are integrated can be used for the driver circuit SD. Specifically, an integrated circuit formed over a silicon substrate can be used for the driver circuit SD.

The controller 11 may be included in the same integrated circuit as the driver circuit SD. Specifically, an integrated circuit formed over a silicon substrate can be used for each of the controller 11 and the driver circuit SD.

For example, the above integrated circuit can be mounted on a terminal by a chip on glass (COG) method or a chip on film (COF) method. Specifically, an anisotropic conductive film can be used to mount an integrated circuit on the terminal.

<<Pixel Circuit>>

Figure 14:
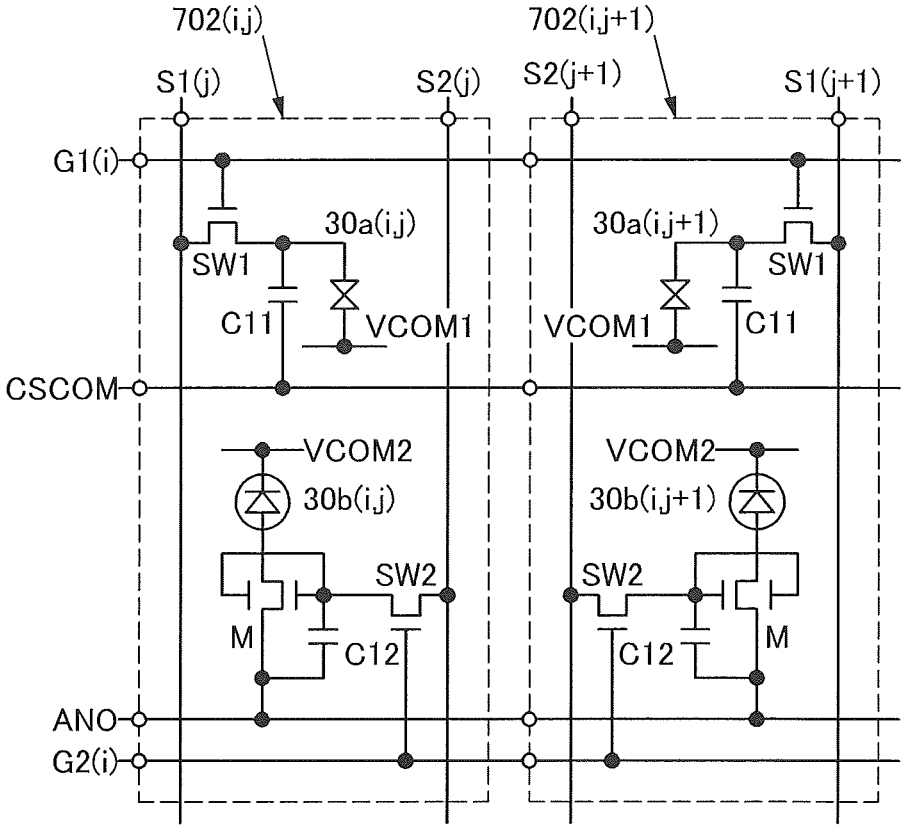
FIG. 14 is a circuit diagram illustrating configuration examples of pixels.

FIG. 14 is a circuit diagram illustrating configuration examples of pixels 702. The pixel 702(i,j) has a function of driving a display element 30*a*(i,j) and a display element 30*b*(i,j). Accordingly, the display element 30*a* and the display element 30*b* which perform display using different methods can be driven with one pixel circuit, for example. Specifically, a reflective display element is used as the display element 30*a*, whereby the power consumption can be reduced. Alternatively, an image with high contrast can be favorably displayed in an environment with bright external light. Alternatively, the display element 30*b* which emits light is used, whereby an image can be favorably displayed in a dark environment.

The pixel 702(i,j) is electrically connected to the signal line S1(j), the signal line S2(j), the scan line G1(i), the scan line G2(i), the wiring CSCOM, and the wiring ANO.

The pixel 702(i,j) includes a switch SW1, a capacitor C11, a switch SW2, a transistor M, and a capacitor C12.

A transistor that includes a gate electrode electrically connected to the scan line G1(i) and a first electrode electrically connected to the signal line S1(j) can be used as the switch SW1.

The capacitor C11 includes a first electrode electrically connected to a second electrode of the transistor used as the switch SW1 and includes a second electrode electrically connected to the wiring CSCOM.

A transistor that includes a gate electrode electrically connected to the scan line G2(i) and a first electrode electrically connected to the signal line S2(j) can be used as the switch SW2.

The transistor M includes a gate electrode electrically connected to a second electrode of the transistor used as the switch SW2 and includes a first electrode electrically connected to the wiring ANO.

Note that the transistor M may include a first gate electrode and a second gate electrode. The first gate electrode and the second gate electrode may be electrically connected to each other. The first gate electrode and the second gate electrode preferably have regions overlapping with each other with a semiconductor film positioned therebetween.

The capacitor C12 includes a first electrode electrically connected to the second electrode of the transistor used as the switch SW2 and includes a second electrode electrically connected to the first electrode of the transistor M.

A first electrode of the display element 30*a*(i,j) is electrically connected to the second electrode of the transistor used as the switch SW1. A second electrode of the display element 30*a*(i,j) is electrically connected to a wiring VCOM1. This enables the display element 30*a*(i,j) to be driven.

A first electrode of the display element 30*b*(i,j) is electrically connected to a second electrode of the transistor M. A second electrode of the display element 30*b*(i,j) is electrically connected to a wiring VCOM2. This enables the display element 30*b*(i,j) to be driven.

<Top View of Display Panel>

Figure 15A:
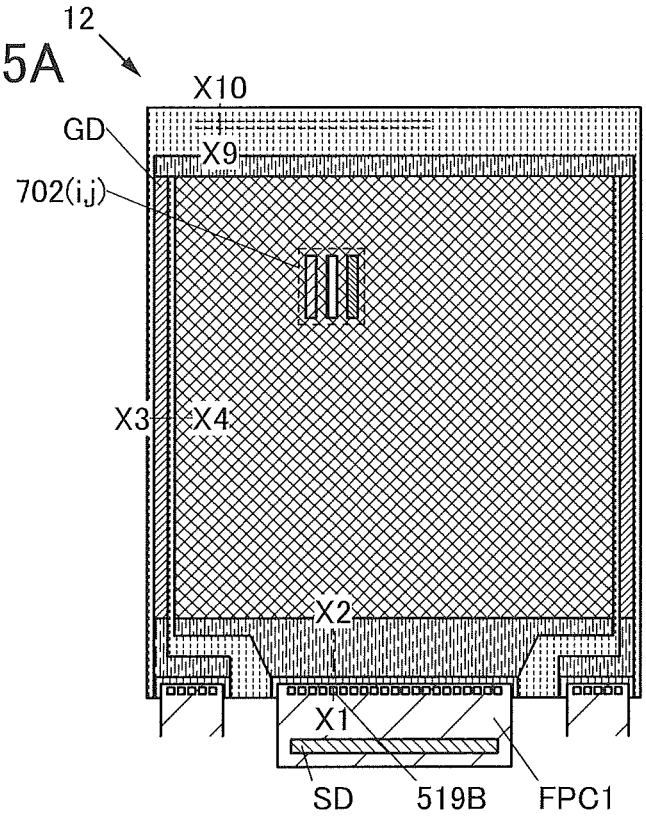
FIGS. 15A to 15C are top views illustrating structure examples of a display panel and a pixel.
Figure 15B:
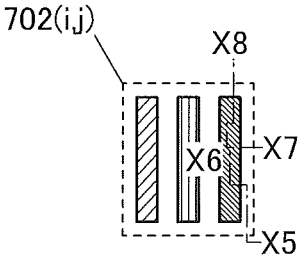
Figure 15C:
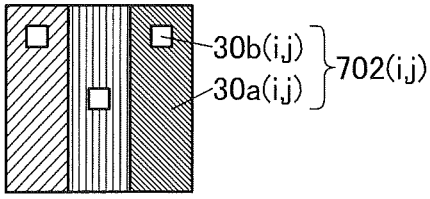

FIGS. 15A to 15C illustrate a structure of the display panel 12. FIG. 15A is a top view of the display panel 12, and FIG. 15B is a top view illustrating part of a pixel of the display panel 12 in FIG. 15A. FIG. 15C is a schematic view illustrating a structure of the pixel in FIG. 15B.

In FIG. 15A, the driver circuit SD and a terminal 519B are provided over a flexible printed circuit FPC1.

In FIG. 15C, the pixel 702(i,j) includes the display element 30*a*(i,j) and the display element 30*b*(i,j).

<Cross-sectional View of Display Panel>

Figure 16A:
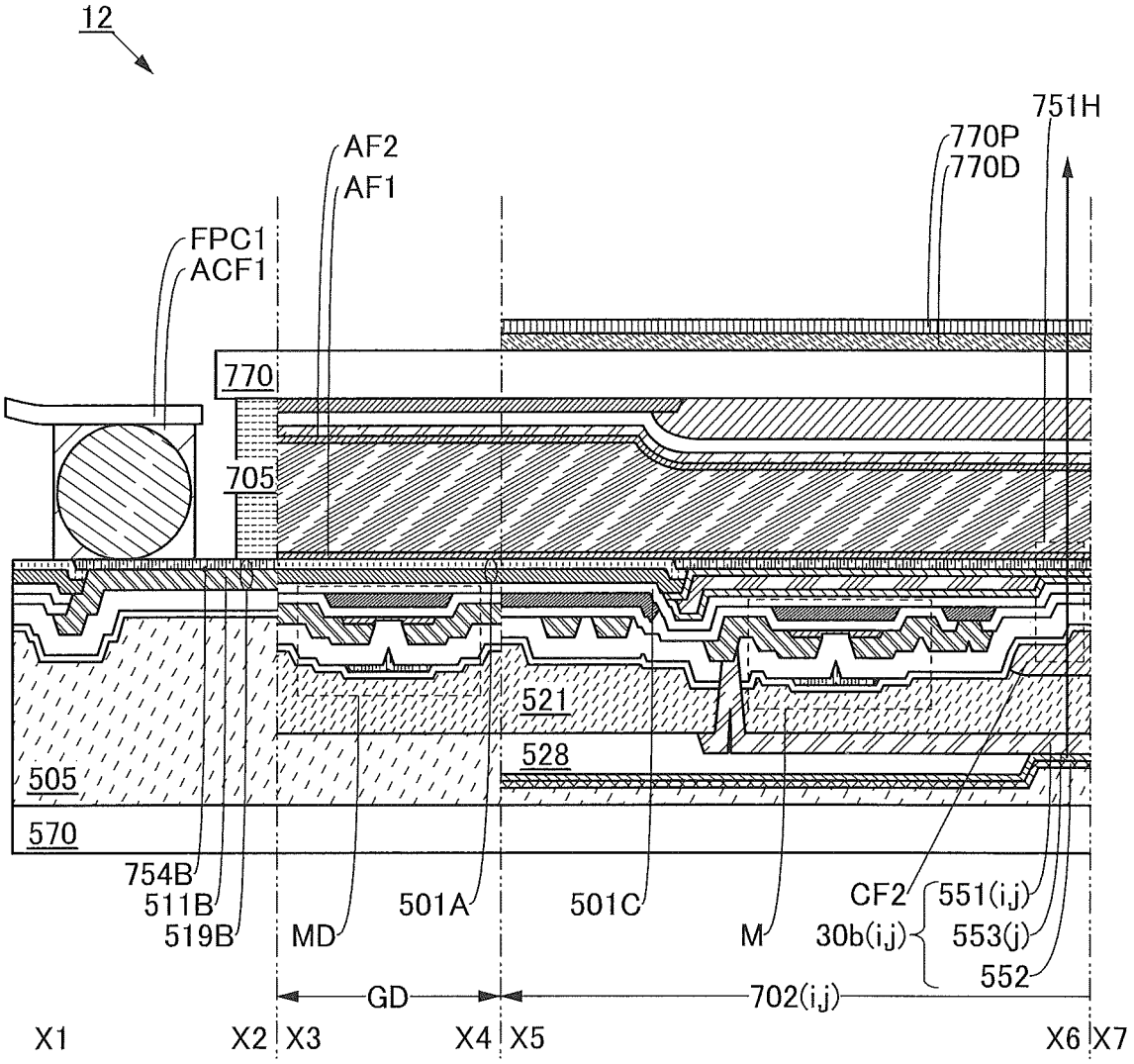
FIGS. 16A and 16B are cross-sectional views illustrating a structure example of a display panel.
Figure 16B:
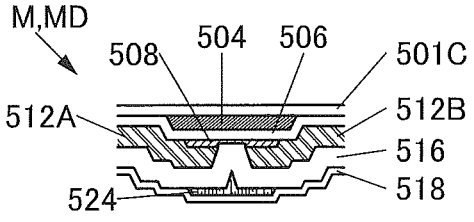

FIGS. 16A and 16B and FIGS. 17A and 17B are cross-sectional views illustrating a structure of the display panel 12. FIG. 16A is a cross-sectional view taken along lines X1-X2, X3-X4, and X5-X6 in FIGS. 15A and 15B, and FIG. 16B illustrates part of FIG. 16A.

Figure 17A:
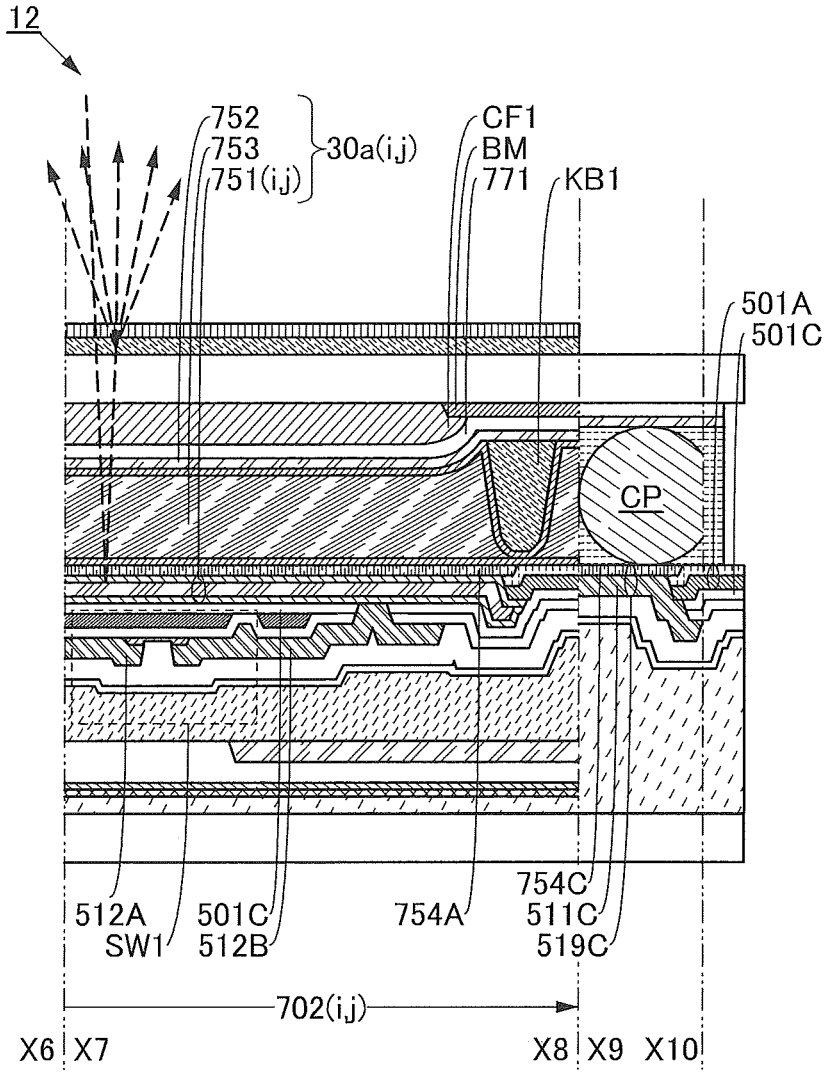
FIGS. 17A and 17B are cross-sectional views illustrating a structure example of a display panel.
Figure 17B:
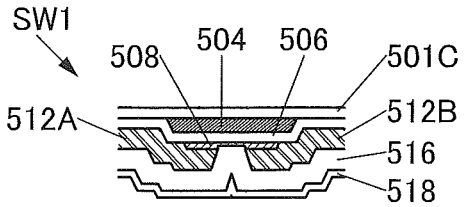

FIG. 17A is a cross-sectional view taken along lines X7-X8 and X9-X10 in FIGS. 15A and 15B, and FIG. 17B illustrates part of FIG. 17A.

Components of the display panel 12 are described below with reference to FIGS. 16A and 16B and FIGS. 17A and 17B.

<<Substrate 570>>

The substrate 570 or the like can be formed using a material having heat resistance high enough to withstand heat treatment in the manufacturing process. For example, a material with a thickness greater than or equal to 0.1 mm and less than or equal to 0.7 mm can be used as the substrate 570. Specifically, a material polished to a thickness of approximately 0.1 mm can be used.

For example, a large-sized glass substrate having any of the following sizes can be used as the substrate 570 or the like: the 6th generation (1500 mm×1850 mm), the 7th generation (1870 mm×2200 mm), the 8th generation (2200 mm×2400 mm), the 9th generation (2400 mm×2800 mm), and the 10th generation (2950 mm×3400 mm). Thus, a large-sized display device can be manufactured.

For the substrate 570 or the like, an organic material, an inorganic material, a composite material of an organic material and an inorganic material, or the like can be used. For example, an inorganic material such as glass, ceramic, or metal can be used for the substrate 570 or the like.

Specifically, non-alkali glass, soda-lime glass, potash glass, crystal glass, aluminosilicate glass, tempered glass, chemically tempered glass, quartz, sapphire, or the like can be used for the substrate 570 or the like. Specifically, an inorganic oxide film, an inorganic nitride film, an inorganic oxynitride film, or the like can be used for the substrate 570 or the like. For example, a silicon oxide film, a silicon nitride film, a silicon oxynitride film, an aluminum oxide film, or the like can be used for the substrate 570 or the like. Stainless steel, aluminum, or the like can be used for the substrate 570 or the like.

For example, a single crystal semiconductor substrate or a polycrystalline semiconductor substrate of silicon or silicon carbide, a compound semiconductor substrate of silicon germanium or the like, an SOI substrate, or the like can be used as the substrate 570 or the like. Thus, a semiconductor element can be provided over the substrate 570 or the like.

For example, an organic material such as a resin, a resin film, or plastic can be used for the substrate 570 or the like. Specifically, a resin film or a resin plate of polyester, polyolefin, polyamide, polyimide, polycarbonate, an acrylic resin, or the like can be used for the substrate 570 or the like.

For example, a composite material formed by attaching a metal plate, a thin glass plate, or a film of an inorganic material to a resin film or the like can be used for the substrate 570 or the like. For example, a composite material formed by dispersing a fibrous or particulate metal, glass, an inorganic material, or the like into a resin film can be used for the substrate 570 or the like. For example, a composite material formed by dispersing a fibrous or particulate resin, an organic material, or the like into an inorganic material can be used for the substrate 570 or the like.

Furthermore, a single-layer material or a layered material in which a plurality of layers are stacked can be used for the substrate 570 or the like. For example, a layered material in which a base, an insulating film that prevents diffusion of impurities contained in the base, and the like are stacked can be used for the substrate 570 or the like. Specifically, a layered material in which glass and one or a plurality of films that are selected from a silicon oxide layer, a silicon nitride layer, a silicon oxynitride layer, and the like and that prevent diffusion of impurities contained in the glass are stacked can be used for the substrate 570 or the like. Alternatively, a layered material in which a resin and a film for preventing diffusion of impurities that penetrate the resin, such as a silicon oxide film, a silicon nitride film, or a silicon oxynitride film, are stacked can be used for the substrate 570 or the like.

Specifically, a resin film, a resin plate, a layered material, or the like of polyester, polyolefin, polyamide, polyimide, polycarbonate, an acrylic resin, or the like can be used for the substrate 570 or the like.

Specifically, a material including polyester, polyolefin, polyamide (e.g., nylon or aramid), polyimide, polycarbonate, polyurethane, an acrylic resin, an epoxy resin, or a resin having a siloxane bond, such as silicone, can be used for the substrate 570 or the like.

Specifically, polyethylene terephthalate (PET), polyethylene naphthalate (PEN), polyethersulfone (PES), an acrylic resin, or the like can be used for the substrate 570 or the like. Alternatively, a cyclo-olefin polymer (COP), a cyclo-olefin copolymer (COC), or the like can be used.

Alternatively, paper, wood, or the like can be used for the substrate 570 or the like.

For example, a flexible substrate can be used as the substrate 570 or the like.

Note that a transistor, a capacitor, or the like can be directly formed on the substrate. Alternatively, a transistor, a capacitor, or the like formed over a substrate for use in manufacturing processes which can withstand heat applied in the manufacturing process can be transferred to the substrate 570 or the like. Accordingly, a transistor, a capacitor, or the like can be formed over a flexible substrate, for example.

<<Substrate 770>>

For example, a light-transmitting material can be used for the substrate 770. Specifically, any of the materials that can be used for the substrate 570 can be used for the substrate 770.

For example, aluminosilicate glass, tempered glass, chemically tempered glass, sapphire, or the like can be favorably used for the substrate 770 that is provided on the user side of the display panel. This can prevent damage or a crack of the display panel caused by the use thereof.

Moreover, a material having a thickness greater than or equal to 0.1 mm and less than or equal to 0.7 mm, for example, can be used for the substrate 770. Specifically, a substrate polished for reducing the thickness can be used. Thus, a functional film 770D can be located so as to be close to the display element 30*a*(i,j). As a result, image blur can be reduced and an image can be displayed clearly.

<<Structure Body KB1>>

For example, an organic material, an inorganic material, or a composite material of an organic material and an inorganic material can be used for a structure body KB1 or the like. Accordingly, a predetermined space can be provided between components between which the structure body KB1 and the like are provided.

Specifically, for the structure body KB1, polyester, polyolefin, polyamide, polyimide, polycarbonate, polysiloxane, an acrylic resin, or the like, or a composite material of a plurality of resins selected from these can be used. Alternatively, a photosensitive material may be used.

<<Sealant 705>>

For a sealant 705 or the like, an inorganic material, an organic material, a composite material of an inorganic material and an organic material, or the like can be used.

For example, an organic material such as a thermally fusible resin or a curable resin can be used for the sealant 705 or the like.

For example, an organic material such as a reactive curable adhesive, a photo-curable adhesive, a thermosetting adhesive, and/or an anaerobic adhesive can be used for the sealant 705 or the like.

Specifically, an adhesive containing an epoxy resin, an acrylic resin, a silicone resin, a phenol resin, a polyimide resin, an imide resin, a polyvinyl chloride (PVC) resin, a polyvinyl butyral (PVB) resin, an ethylene vinyl acetate (EVA) resin, or the like can be used for the sealant 705 or the like.

<<Bonding Layer 505>>

For example, any of the materials that can be used for the sealant 705 can be used for a bonding layer 505.

<<Insulating Film 521 and Insulating Film 518>>

For example, an insulating inorganic material, an insulating organic material, or an insulating composite material containing an inorganic material and an organic material can be used for insulating films 521 and 518 and the like.

Specifically, an inorganic oxide film, an inorganic nitride film, an inorganic oxynitride film, or a layered material obtained by stacking some of these films can be used as the insulating films 521 and 518 and the like. For example, a film including any of a silicon oxide film, a silicon nitride film, a silicon oxynitride film, an aluminum oxide film, and the like, or a film including a material obtained by stacking some of these films can be used as the insulating films 521 and 518 and the like.

Specifically, for the insulating films 521 and 518 and the like, polyester, polyolefin, polyimide, polyimide, polycarbonate, polysiloxane, an acrylic resin, or the like, or a layered or composite material of a plurality of kinds of resins selected from these can be used. Alternatively, a photosensitive material may be used.

Thus, steps due to various components overlapping with the insulating films 521 and 518, for example, can be reduced.

<<Insulating Film 528>>

For example, any of the materials that can be used for the insulating film 521 can be used for an insulating film 528 or the like. Specifically, a 1-μm-thick polyimide-containing film can be used as the insulating film 528.

<<Insulating Film 501A>>

For example, any of the materials that can be used for the insulating film 521 can be used for an insulating film 501A. For example, a material having a function of supplying hydrogen can be used for the insulating film 501A.

Specifically, a material obtained by stacking a material containing silicon and oxygen and a material containing silicon and nitrogen can be used for the insulating film 501A. For example, a material having a function of releasing hydrogen by heating or the like to supply the hydrogen to another component can be used for the insulating film 501A. Specifically, a material having a function of releasing hydrogen taken in the manufacturing process, by heating or the like, to supply the hydrogen to another component can be used for the insulating film 501A.

For example, a film containing silicon and oxygen that is formed by a chemical vapor deposition method using silane or the like as a source gas can be used as the insulating film 501A.

Specifically, a material obtained by stacking a material containing silicon and oxygen and having a thickness greater than or equal to 200 nm and less than or equal to 600 nm and a material containing silicon and nitrogen and having a thickness of approximately 200 nm can be used for the insulating film 501A.

<<Insulating Film 501C>>

For example, any of the materials that can be used for the insulating film 521 can be used for an insulating film 501C. Specifically, a material containing silicon and oxygen can be used for the insulating film 501C. Thus, impurity diffusion into the pixel circuit or the display element 30*b*(i,j) can be suppressed.

For example, a 200-nm-thick film containing silicon, oxygen, and nitrogen can be used as the insulating film 501C.

<<Intermediate Film 754A, Intermediate Film 754B, and Intermediate Film 754C>>

For example, a film with a thickness greater than or equal to 10 nm and less than or equal to 500 nm, preferably greater than or equal to 10 nm and less than or equal to 100 nm can be used as an intermediate film 754A, an intermediate film 754B, or an intermediate film 754C.

In this specification, the intermediate film 754A, the intermediate film 754B, or the intermediate film 754C is referred to as an intermediate film.

For example, a material having a function of allowing the passage of hydrogen or the supply of hydrogen can be used for the intermediate film.

For example, a conductive material can be used for the intermediate film.

For example, a light-transmitting material can be used for the intermediate film.

Specifically, a material containing indium and oxygen, a material containing indium, gallium, zinc, and oxygen, a material containing indium, tin, and oxygen, or the like can be used for the intermediate film. Note that these materials have a function of allowing the passage of hydrogen.

Specifically, a 50- or 100-nm-thick film containing indium, gallium, zinc, and oxygen can be used as the intermediate film.

Note that a material obtained by stacking films serving as an etching stopper can be used as the intermediate film. Specifically, a layered material obtained by stacking a 50-nm-thick film containing indium, gallium, zinc, and oxygen and a 20-nm-thick film containing indium, tin, and oxygen, in this order, can be used for the intermediate film.

<<Wiring, Terminal, Conductive Film>>

A conductive material can be used for a wiring or the like. Specifically, the conductive material can be used for the signal line S1(j), the signal line S2(j), the scan line G1(i), the scan line G2(i), the wiring CSCOM, the wiring ANO, the terminal 519B, a terminal 519C, a conductive film 511B, a conductive film 511C, or the like.

For example, an inorganic conductive material, an organic conductive material, a metal material, a conductive ceramic material, or the like can be used for the wiring or the like.

Specifically, a metal element selected from aluminum, gold, platinum, silver, copper, chromium, tantalum, titanium, molybdenum, tungsten, nickel, iron, cobalt, palladium, and manganese, or the like can be used for the wiring or the like. Alternatively, an alloy including any of the above-described metal elements, or the like can be used for the wiring or the like. In particular, an alloy of copper and manganese is suitably used in microfabrication with use of a wet etching method.

Specifically, a two-layer structure in which a titanium film is stacked over an aluminum film, a two-layer structure in which a titanium film is stacked over a titanium nitride film, a two-layer structure in which a tungsten film is stacked over a titanium nitride film, a two-layer structure in which a tungsten film is stacked over a tantalum nitride film or a tungsten nitride film, a three-layer structure in which a titanium film, an aluminum film, and a titanium film are stacked in this order, or the like can be used for the wiring or the like.

Specifically, a conductive oxide such as indium oxide, indium tin oxide, indium zinc oxide, zinc oxide, or zinc oxide to which gallium is added can be used for the wiring or the like.

Specifically, a film containing graphene or graphite can be used for the wiring or the like.

For example, a film including graphene oxide is formed and is reduced, so that a film including graphene can be formed. As a reducing method, a method using heat, a method using a reducing agent, or the like can be employed.

For example, a film including a metal nanowire can be used for the wiring or the like. Specifically, a nanowire including silver can be used.

Specifically, a conductive polymer can be used for the wiring or the like.

Note that the terminal 519B can be electrically connected to a flexible printed circuit FPC1 using a conductive material ACF1, for example.

<<Display Element 30*a*(i,j)>>

For example, a display element having a function of controlling transmission or reflection of light can be used as the display element 30*a*(i,j). For example, a combined structure of a liquid crystal element and a polarizing plate or a MEMS shutter display element can be used. Specifically, a reflective liquid crystal display element can be used as the display element 30*a*(i,j). The use of a reflective display element can reduce the power consumption of a display panel.

For example, a liquid crystal element that can be driven by any of the following driving methods can be used: an in-plane switching (IPS) mode, a twisted nematic (TN) mode, a fringe field switching (FFS) mode, an axially symmetric aligned micro-cell (ASM) mode, an optically compensated birefringence (OCB) mode, a ferroelectric liquid crystal (FLC) mode, an antiferroelectric liquid crystal (AFLC) mode, and the like.

In addition, a liquid crystal element that can be driven by, for example, a vertical alignment (VA) mode such as a multi-domain vertical alignment (MVA) mode, a patterned vertical alignment (PVA) mode, an electrically controlled birefringence (ECB) mode, a continuous pinwheel alignment (CPA) mode, or an advanced super view (ASV) mode can be used.

The display element 30*a*(i,j) includes an electrode 751(i, j), an electrode 752, and a layer 753 containing a liquid crystal material. The layer 753 contains a liquid crystal material whose alignment is controlled by a voltage applied between the electrode 751(i,j) and the electrode 752. For example, the alignment of the liquid crystal material can be controlled by an electric field in the thickness direction (also referred to as the vertical direction) of the layer 753 or the direction that crosses the vertical direction (the horizontal direction, or the diagonal direction).

For example, thermotropic liquid crystal, low-molecular liquid crystal, high-molecular liquid crystal, polymer dispersed liquid crystal, ferroelectric liquid crystal, anti-ferroelectric liquid crystal, or the like can be used for the layer 753. A liquid crystal material that exhibits a cholesteric phase, a smectic phase, a cubic phase, a chiral nematic phase, an isotropic phase, or the like can be used. Alternatively, a liquid crystal material that exhibits a blue phase can be used.

For example, the material that is used for the wiring or the like can be used for the electrode 751(i,j). Specifically, a reflective film can be used for the electrode 751(i,j). For example, a material in which a light-transmitting conductive film and a reflective film having an opening are stacked can be used for the electrode 751(i,j).

For example, a conductive material can be used for the electrode 752. For example, a material having a visible-light-transmitting property can be used for the electrode 752.

For example, a conductive oxide, a metal film thin enough to transmit light, or a metal nanowire can be used for the electrode 752.

Specifically, a conductive oxide containing indium can be used for the electrode 752. Alternatively, a metal thin film with a thickness greater than or equal to 1 nm and less than or equal to 10 nm can be used for the electrode 752. Alternatively, a metal nanowire containing silver can be used for the electrode 752.

Specifically, indium oxide, indium tin oxide, indium zinc oxide, zinc oxide, zinc oxide to which gallium is added, zinc oxide to which aluminum is added, or the like can be used for the electrode 752.

<<Reflective Film>>

For example, a material reflecting visible light can be used for the reflective film. Specifically, a material containing silver can be used for the reflective film. For example, a material containing silver, palladium, and the like or a material containing silver, copper, and the like can be used for the reflective film.

The reflective film reflects light that passes through the layer 753, for example. This allows the display element 30*a*(i,j) to serve as a reflective liquid crystal element. Alternatively, a material with an uneven surface can be used for the reflective film. In that case, incident light can be reflected in various directions so that a white image can be displayed.

For example, the electrode 751(i,j) or the like can be used as the reflective film.

For example, the reflective film can be provided as a film that includes a region sandwiched between the layer 753 and the electrode 751(i,j). In the case where the electrode 751(i,j) has a light-transmitting property, the reflective film can be provided as a film that includes a region overlapping with the layer 753 with the electrode 751(i,j) positioned between the film and the layer 753.

The reflective film preferably includes a region that does not block light emitted from the display element 30*b*(i,j), for example. The reflective film preferably has a shape with one or more openings 751H, for example.

The opening may have a polygonal shape, a quadrangular shape, an elliptical shape, a circular shape, a cross-like shape, or the like. The opening 751H may also have a stripe shape, a slit-like shape, or a checkered pattern.

If the ratio of the total area of the opening 751H to the total area except for the openings is too high, display performed using the display element 30*a*(i,j) is dark.

If the ratio of the total area of the opening 751H to the total area except for the openings is too low, display performed using the display element 30*b*(i,j) is dark.

Figure 18A:
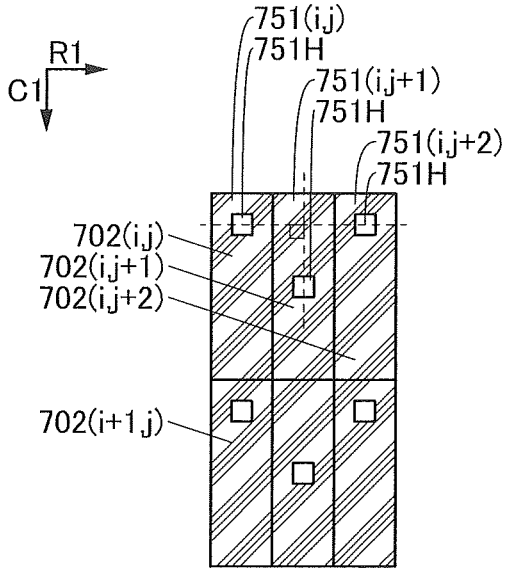
FIGS. 18A to 18C are schematic views illustrating shapes of reflective films.
Figure 18B:
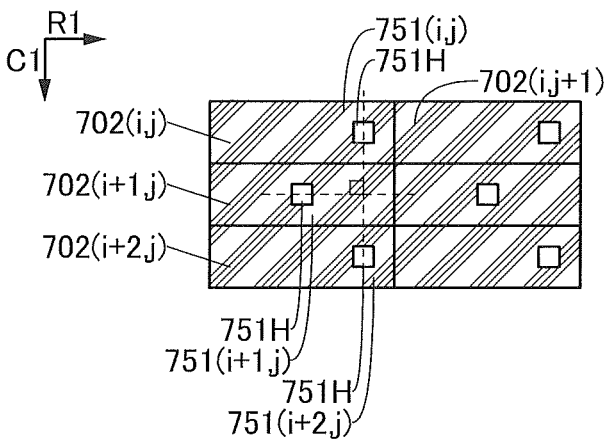
Figure 18C:
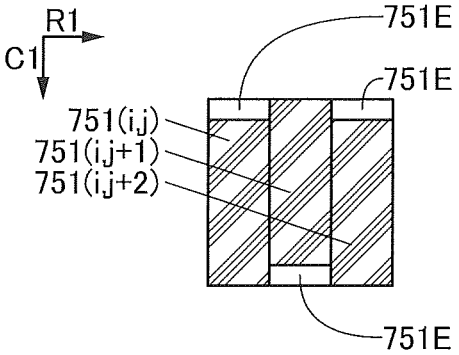

FIGS. 18A to 18C are schematic views each illustrating the shape of the reflective film that can be used in the pixel of the display panel 12.

The opening 751H of the pixel 702(i,j+1), which is adjacent to the pixel 702(i,j), is not provided on a line that extends in the row direction (the direction indicated by the arrow R1 in each of FIGS. 18A to 18C) through the opening 751H of the pixel 702(i,j) (see FIG. 18A). Alternatively, for example, the opening 751H of the pixel 702(i+1,j), which is adjacent to the pixel 702(i,j), is not provided on a line that extends in the column direction (the direction indicated by the arrow C1 in each of FIGS. 18A to 18C) through the opening 751H of the pixel 702(i,j) (see FIG. 18B).

For example, the opening 751H of the pixel 702(i,j+2) is provided on a line that extends in the row direction through the opening 751H of the pixel 702(i,j) (see FIG. 18A). In addition, the opening 751H of the pixel 702(i,j+1) is provided on a line that is perpendicular to the above-mentioned line between the opening 751H of the pixel 702(i,j) and the opening 751H of the pixel 702(i,j+2).

Alternatively, for example, the opening 751H of the pixel 702(i+2,j) is provided on a line that extends in the column direction through the opening 751H of the pixel 702(i,j) (see FIG. 18B). In addition, for example, the opening 751H of the pixel 702(i+1,j) is provided on a line that is perpendicular to the above-mentioned line between the opening 751H of the pixel 702(i,j) and the opening 751H of the pixel 702(i+2,j).

Thus, the display element 30*b* that includes a region overlapping with an opening of a pixel adjacent to one pixel can be apart from the display element 30*b* that includes a region overlapping with an opening of the one pixel. Furthermore, a display element that exhibits color different from that exhibited by the display element 30*b* of the one pixel can be provided as the display element 30*b* of the pixel adjacent to the one pixel. Furthermore, the difficulty in adjacently arranging a plurality of display elements that exhibit different colors can be lowered.

For example, the reflective film can be formed using a material having a shape in which an end portion is cut off so as to form a region 751E that does not block light emitted from the display element 30*b*(i,j) (see FIG. 18C). Specifically, the electrode 751(i,j) whose end portion is cut off so as to be shorter in the column direction (the direction indicated by the arrow C1 in the drawing) can be used as the reflective film.

<<Alignment Film AF1 and Alignment Film AF2>>

For example, the alignment films AF1 and AF2 can be formed with a material containing polyimide or the like. Specifically, a material formed by rubbing treatment or an optical alignment technique so that a liquid crystal material has alignment in a predetermined direction can be used.

For example, a film containing soluble polyimide can be used as the alignment film AF1 or AF2. In this case, the temperature required in forming the alignment film AF1 or AF2 can be low. Accordingly, damage to other components at the time of forming the alignment film AF1 or AF2 can be suppressed.

<<Coloring Film CF1 and Coloring Film CF2>>

A material transmitting light of a predetermined color can be used for the coloring film CF1 or the coloring film CF2. Thus, the coloring film CF1 or the coloring film CF2 can be used as a color filter, for example. For example, a material that transmits blue light, green light, or red light can be used for the coloring film CF1 or the coloring film CF2. Furthermore, a material that transmits yellow light, white light, or the like can be used for the coloring film CF1 or the coloring film CF2.

Note that a material having a function of converting the emitted light to a predetermined color light can be used for the coloring film CF2. Specifically, quantum dots can be used for the coloring film CF2. Thus, display with high color purity can be achieved.

<<Light-blocking Film BM>>

A material that prevents light transmission can be used for the light-blocking film BM. Thus, the light-blocking film BM can be used as, for example, a black matrix.

<<Insulating Film 771>>

The insulating film 771 can be formed of polyimide, an epoxy resin, or an acrylic resin, for example.

<<Functional Film 770P and Functional Film 770D>>

For example, an anti-reflection film, a polarizing film, a retardation film, a light diffusion film, a condensing film, or the like can be used as a functional film 770P or the functional film 770D.

Specifically, a film containing a dichromatic pigment can be used as the functional film 770P or the functional film 770D. Furthermore, a material having a pillar-shaped structure with an axis in a direction that intersects a surface of the substrate can be used for the functional film 770P or the functional film 770D. This makes it easy to transmit light in a direction along the axis and to scatter light in the other directions.

Alternatively, an antistatic film inhibiting the attachment of a foreign substance, a water repellent film inhibiting the attachment of stain, a hard coat film inhibiting a scratch in use, or the like can be used as the functional film 770P.

Specifically, a circularly polarizing film can be used as the functional film 770P. Furthermore, a light diffusion film can be used as the functional film 770D.

<<Display Element 30*b*(i,j)>>

For example, the display element 30*b*(i,j) can be a light-emitting element. Specifically, an organic electroluminescent element, an inorganic electroluminescent element, a light-emitting diode, or the like can be used as the display element 30*b*(i,j).

The display element 30*b*(i,j) includes an electrode 551(i, j), an electrode 552, and a layer 553(j) containing a light-emitting material.

For example, a light-emitting organic compound can be used for the layer 553(j).

For example, quantum dots can be used for the layer 553(j). Accordingly, the half width becomes narrow, and light of a bright color can be emitted.

For example, a layered material for emitting blue light, green light, or red light, or the like can be used for the layer 553(j).

For example, a belt-like layered material that extends in the column direction along the signal line S2(j) can be used for the layer 553(j).

Alternatively, a layered material for emitting white light can be used for the layer 553(j). Specifically, a layered material in which a layer including a fluorescent material that emits blue light, and a layer containing materials that are other than a fluorescent material and that emit green light and red light or a layer containing a material that is other than a fluorescent material and that emits yellow light are stacked can be used for the layer 553(j).

For example, a material that can be used for the wiring or the like can be used for the electrode 551(i,j).

For example, a material that transmits visible light selected from materials that can be used for the wiring or the like can be used for the electrode 551(i,j).

Specifically, conductive oxide, indium-containing conductive oxide, indium oxide, indium tin oxide, indium zinc oxide, zinc oxide, zinc oxide to which gallium is added, or the like can be used for the electrode 551(i,j). Alternatively, a metal film that is thin enough to transmit light can be used as the electrode 551(i,j). Further alternatively, a metal film that transmits part of light and reflects another part of light can be used as the electrode 551(i,j). Thus, the display element 30*b*(i,j) can be provided with a microcavity structure. Consequently, light of a predetermined wavelength can be extracted more efficiently than light of the other wavelengths.

For example, a material that can be used for the wiring or the like can be used for the electrode 552. Specifically, a material that reflects visible light can be used for the electrode 552.

<<Driver Circuit GD>>

Any of a variety of sequential circuits, such as a shift register, can be used as the driver circuit GD. For example, a transistor MD, a capacitor, and the like can be used in the driver circuit GD. Specifically, a transistor including a semiconductor film that can be formed in the same process as the transistor M or the transistor which can be used as the switch SW1 can be used.

As the transistor MD, a transistor having a different structure from the transistor that can be used as the switch SW1 can be used, for example. Specifically, a transistor including a conductive film 524 can be used as the transistor MD.

Note that the transistor MD can have the same structure as the transistor M.

<<Transistor>>

For example, semiconductor films formed at the same step can be used for transistors in the driver circuit and the pixel circuit.

For example, a bottom-gate transistor, a top-gate transistor, or the like can be used for transistors in a driver circuit or a pixel circuit.

For example, the OS transistor described in Embodiment 1 can be used. In that case, the above-mentioned idling stop can be performed.

For example, a transistor including an oxide semiconductor film 508, a conductive film 504, a conductive film 512A, and a conductive film 512B can be used as the switch SW1 (see FIG. 17B). Note that an insulating film 506 includes a region sandwiched between the oxide semiconductor film 508 and the conductive film 504.

The conductive film 504 includes a region overlapping with the oxide semiconductor film 508. The conductive film 504 has a function of a gate electrode. The insulating film 506 has a function of a gate insulating film.

The conductive film 512A and the conductive film 512B are electrically connected to the oxide semiconductor film 508. The conductive film 512A has one of a function of a source electrode and a function of a drain electrode, and the conductive film 512B has the other.

A transistor including the conductive film 524 can be used as the transistor in the driver circuit or the pixel circuit. The conductive film 524 includes a region so that the oxide semiconductor film 508 is sandwiched between the conductive film 504 and the region. Note that the insulating film 516 includes a region sandwiched between the conductive film 524 and the oxide semiconductor film 508. For example, the conductive film 524 is electrically connected to a wiring that supplies the same potential as that supplied to the conductive film 504.

A conductive film in which a 10-nm-thick film containing tantalum and nitrogen and a 300-nm-thick film containing copper are stacked in this order can be used as the conductive film 504, for example. Note that the film containing copper includes a region so that the film containing tantalum and nitrogen is sandwiched between the region and the insulating film 506.

A material in which a 400-nm-thick film containing silicon and nitrogen and a 200-nm-thick film containing silicon, oxygen, and nitrogen are stacked can be used for the insulating film 506, for example. Note that the film containing silicon and nitrogen includes a region so that the film containing silicon, oxygen, and nitrogen is sandwiched between the region and the oxide semiconductor film 508.

A 25-nm-thick film containing indium, gallium, and zinc can be used as the oxide semiconductor film 508, for example.

A conductive film in which a 50-nm-thick film containing tungsten, a 400-nm-thick film containing aluminum, and a 100-nm-thick film containing titanium are stacked in this order can be used as the conductive film 512A or the conductive film 512B, for example. Note that the film containing tungsten includes a region in contact with the oxide semiconductor film 508.

This embodiment can be combined with any other embodiment as appropriate.

Figure 19A:
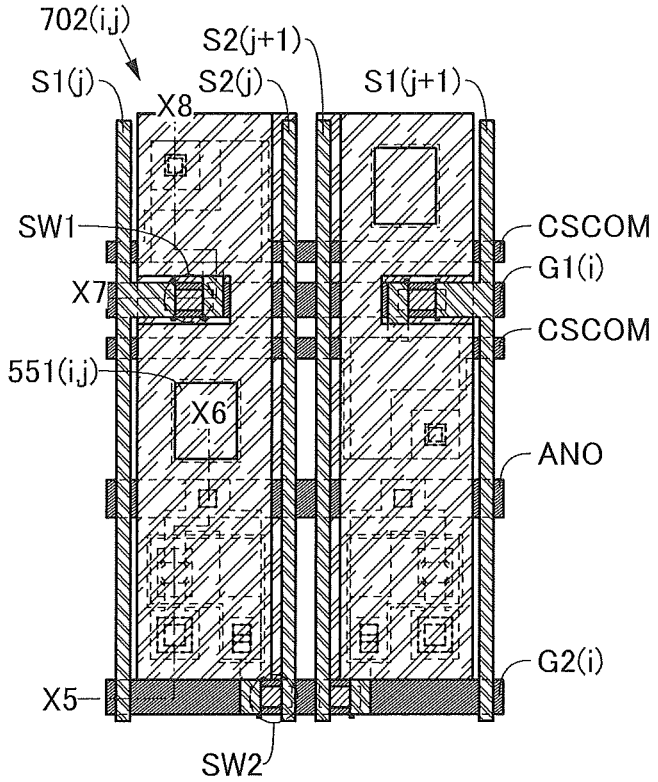
FIGS. 19A and 19B are bottom views illustrating part of a pixel of a display panel.
Figure 19B:
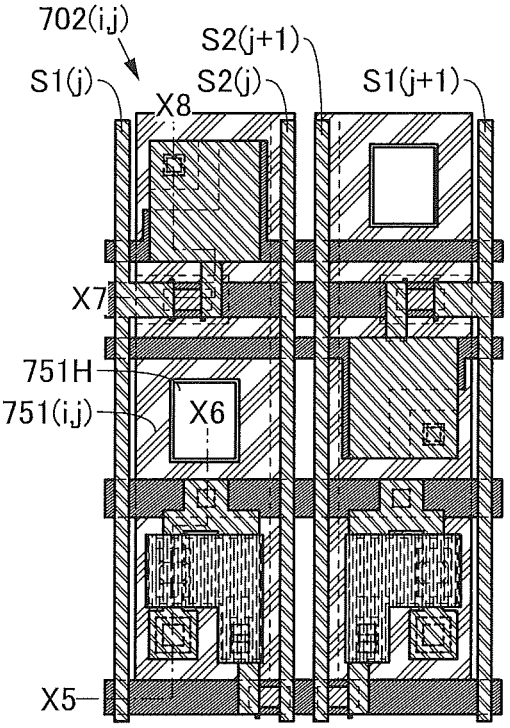

FIG. 19A is a bottom view illustrating part of the pixel of the display panel illustrated in FIG. 15B. FIG. 19B is a bottom view illustrating the part of the structure illustrated in FIG. 19A in which some components are omitted.

(Embodiment 4)

In this embodiment, an input/output panel is described in which a touch panel is included in the display device described in any of the above embodiments.

Figure 20:
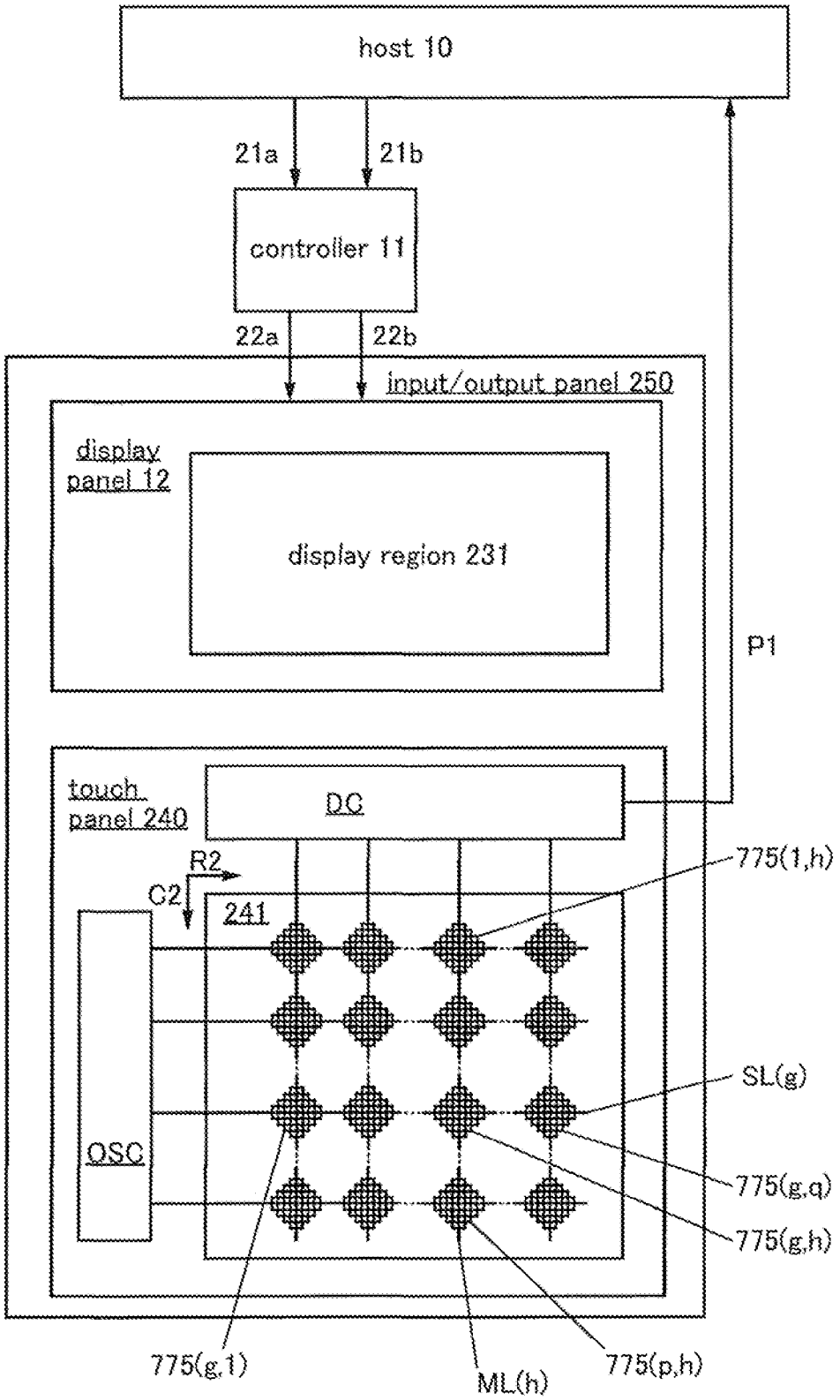
FIG. 20 is a block diagram illustrating a configuration example of an input/output panel.
Figure 21A:
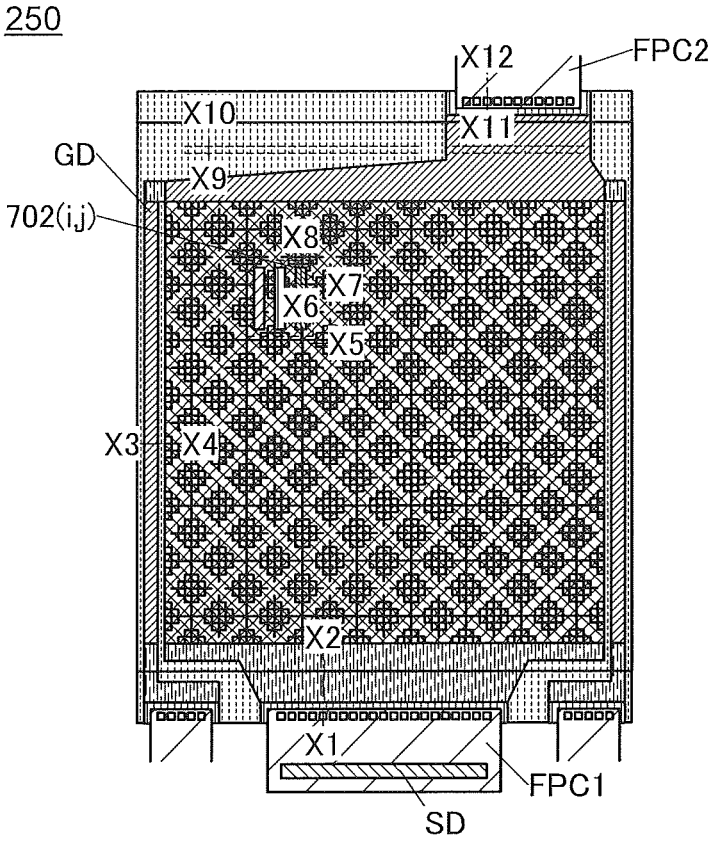
FIGS. 21A and 21B are a top view illustrating an input/output panel and a schematic view illustrating part of an input portion of the input/output panel.
Figure 21B:
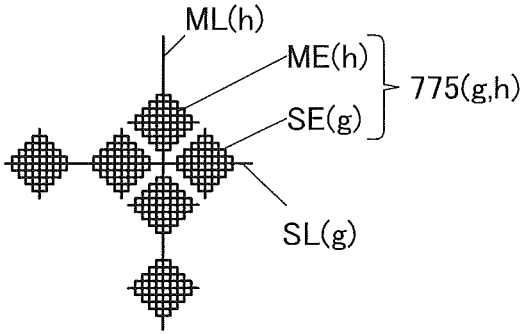

FIG. 20 is a block diagram illustrating the configuration of an input/output panel 250 that includes a touch panel 240 and the display panel 12. FIG. 21A is a top view of the input/output panel 250. FIG. 21B is a schematic view illustrating part of an input portion of the input/output panel 250.

The touch panel 240 includes a sensor region 241, an oscillator circuit OSC, and a sensor circuit DC (see FIG. 20).

The sensor region 241 includes a region overlapping with the display region 231 of the display panel 12. The sensor region 241 has a function of sensing an object approaching the region overlapping with the display region 231.

The sensor region 241 includes one group of sensor elements 775(g,1) to 775(g,q) and another group of sensor elements 775(1,h) to 775(p,h). Note that g is an integer greater than or equal to 1 and less than or equal to p, h is an integer greater than or equal to 1 and less than or equal to q, and p and q are each an integer greater than or equal to 1.

The one group of sensor elements 775(g,1) to 775(g,q) include the sensor element 775(g,h) and are arranged in a row direction (indicated by the arrow R2 in the drawing).

The another group of sensor elements 775(1,h) to 775(p, h) include the sensor element 775(g,h) and are provided in the column direction (the direction indicated by the arrow C2 in the drawing) that intersects the row direction.

The one group of sensor elements 775(g,1) to 775(g,q) provided in the row direction include an electrode SE(g) that is electrically connected to a control line SL(g) (see FIG. 21B).

The another group of sensor elements 775(1,h) to 775(p, h) provided in the column direction include an electrode ME(h) that is electrically connected to a sensor signal line ML(h) (see FIG. 21B).

The electrode SE(g) and the electrode ME(h) preferably have a light-transmitting property.

Note that the control line SL(g) has a function of supplying a control signal.

The sensor signal line ML(h) has a function of receiving a sensor signal.

The electrode ME(h) is placed to form an electric field between the electrode ME(h) and the electrode SE(g). When an object such as a finger approaches the sensor region 241, the above electric field is blocked and the sensor element 775(g,h) supplies the sensor signal.

The oscillator circuit OSC is electrically connected to the control line SL(g) and has a function of supplying a control signal. For example, a rectangular wave, a sawtooth wave, a triangular wave, or the like can be used for the control signal.

The sensor circuit DC is electrically connected to the sensor signal line ML(h) and has a function of supplying a sensor signal P1 on the basis of a change in the potential of the sensor signal line ML(h). Note that the sensor signal P1 includes positional data, for example.

The sensor signal P1 is supplied to the host 10. The host 10 supplies the signals 21*a* and 21*b* in response to the sensor signal P1, so that the image displayed by the display region 231 is updated.

Figure 22A:
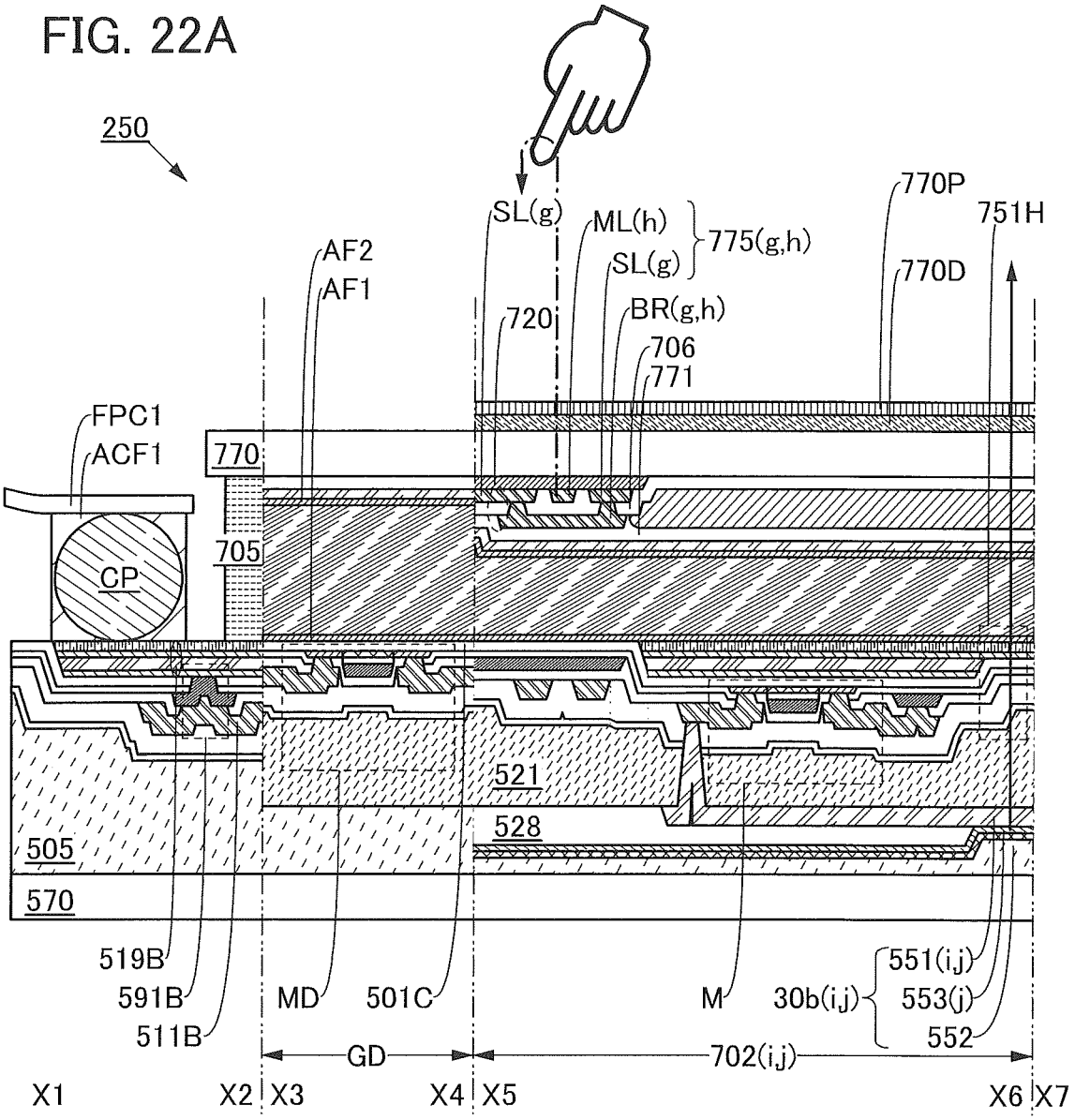
FIGS. 22A and 22B are cross-sectional views illustrating a structure example of an input/output panel.
Figure 22B:
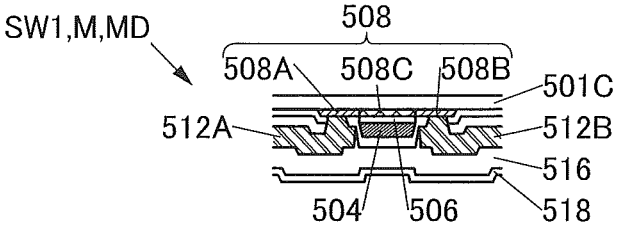
Figure 23:
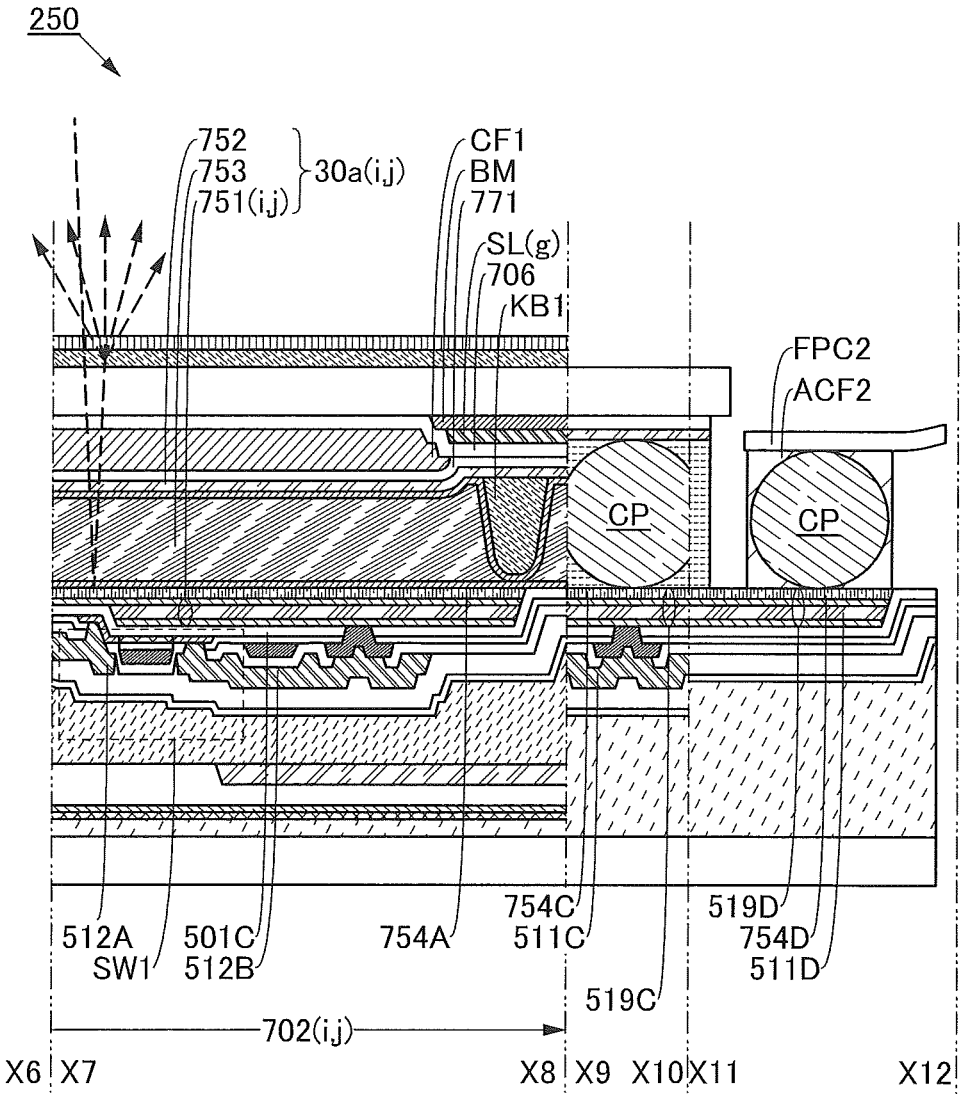
FIG. 23 is a cross-sectional view illustrating a structure example of an input/output panel.

FIGS. 22A and 22B and FIG. 23 illustrate a structure of the input/output panel 250. FIG. 22A is a cross-sectional view taken along lines X1-X2, X3-X4, and X5-X6 in FIG. 21A. FIG. 22B is a cross-sectional view illustrating part of the structure illustrated in FIG. 22A.

FIG. 23 is a cross-sectional view taken along lines X7-X8, X9-X10, and X11-X12 in FIG. 21A.

The input/output panel 250 is different from, for example, the display panel 12 described in Embodiment 3 in that the input/output panel 250 includes a functional layer 720 and a top-gate transistor. Here, the different portions will be described in detail, and the above description is referred to for the other similar portions.

The functional layer 720 includes a region surrounded by the substrate 770, the insulating film 501C, and the sealant 705 (FIGS. 22A and 22B).

The functional layer 720 includes the control line SL(g), the sensor signal line ML(h), and the sensor element 775 (g,h).

The gap between the control line SL(g) and the second electrode 752 or between the sensor signal line ML(h) and the second electrode 752 is greater than or equal to 0.2 μm and less than or equal to 16 μm, preferably greater than or equal to 1 μm and less than or equal to 8 μm, further preferably greater than or equal to 2.5 μm and less than or equal to 4 μm.

The input/output panel 250 includes a conductive film 511D (see FIG. 23).

Note that the conductive material CP or the like can be provided between the control line SL(g) and the conductive film 511D to electrically connect the control line SL(g) and the conductive film 511D. Alternatively, the conductive material CP or the like can be provided between the sensor signal line ML(h) and the conductive film 511D to electrically connect the sensor signal line ML(h) and the conductive film 511D. A material that can be used for the wiring or the like can be used for the conductive film 511D, for example.

The input/output panel 250 includes a terminal 519D (see FIG. 23). The terminal 519D is electrically connected to the conductive film 511D.

The terminal 519D is provided with the conductive film 511D and an intermediate film 754D, and the intermediate film 754D includes a region in contact with the conductive film 511D.

A material that can be used for the wiring or the like can be used for the terminal 519D, for example. Specifically, the terminal 519D can have the same structure as the terminal 519B or the terminal 519C.

Note that the terminal 519D can be electrically connected to the flexible printed circuit FPC2 using a conductive material ACF2, for example. Thus, a control signal can be supplied to the control line SL(g) with use of the terminal 519D, for example. Alternatively, a sensor signal can be supplied from the sensor signal line ML(h) with use of the terminal 519D.

A transistor that can be used as the switch SW1, the transistor M, and the transistor MD each include the conductive film 504 having a region overlapping with the insulating film 501C and the oxide semiconductor film 508 having a region sandwiched between the insulating film 501C and the conductive film 504. Note that the conductive film 504 functions as a gate electrode (see FIG. 22B).

The oxide semiconductor film 508 includes a first region 508A, a second region 508B, and a third region 508C. The first region 508A and the second region 508B do not overlap with the conductive film 504. The third region 508C is positioned between the first region 508A and the second region 508B and overlaps with the conductive film 504.

The transistor MD includes the insulating film 506 between the third region 508C and the conductive film 504. Note that the insulating film 506 functions as a gate insulating film.

The first region 508A and the second region 508B have a lower resistivity than the third region 508C, and function as a source region and a drain region.

For example, an oxide semiconductor film is subjected to plasma treatment using a gas including a rare gas, so that the first region 508A and the second region 508B can be formed in the oxide semiconductor film 508.

For example, the conductive film 504 can be used for a mask. Thus, part of the third region 508C can be formed into a shape of an end of the conductive film 504 in a self-aligned manner.

The transistor MD includes the conductive film 512A and the conductive fihn 512B that are in contact with the first region 508A and the second region 508B, respectively. The conductive film 512A and the conductive film 512B function as a source electrode and a drain electrode.

A transistor that can be fabricated in the same process as the transistor MD can be used as the transistor M, for example.

(Embodiment 5)

In this embodiment, electronic devices including the display device of one embodiment of the present invention will be described with reference to FIGS. 24A to 24H.

FIGS. 24A to 24G illustrate electronic devices. These electronic devices can include a housing 5000, a display portion 5001, a speaker 5003, an LED lamp 5004, operation keys 5005 (including a power switch and an operation switch), a connection terminal 5006, a sensor 5007 (a sensor having a function of measuring force, displacement, position, speed, acceleration, angular velocity, rotational frequency, distance, light, liquid, magnetism, temperature, chemical substance, sound, time, hardness, electric field, current, voltage, electric power, radiation, flow rate, humidity, gradient, oscillation, odor, or infrared ray), a microphone 5008, and the like.

Figure 24A:
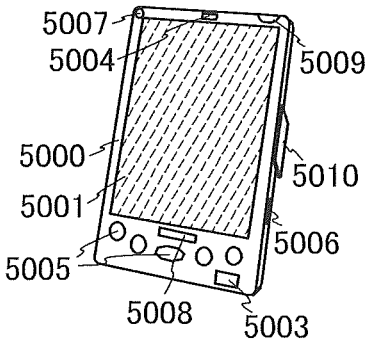
FIGS. 24A to 24H are perspective views illustrating examples of an electronic device.
Figure 24B:
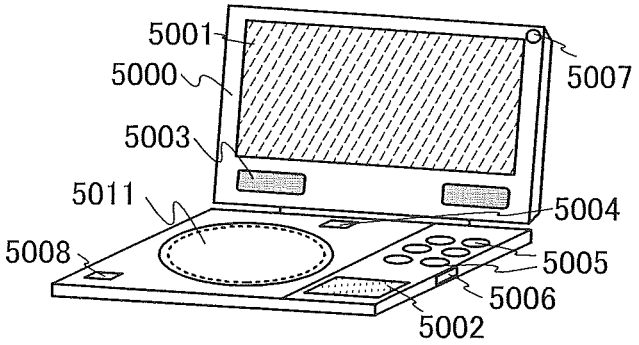
Figure 24C:
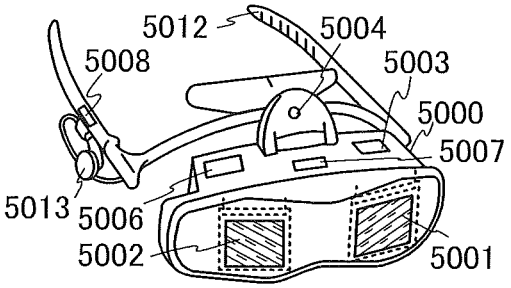
Figure 24D:
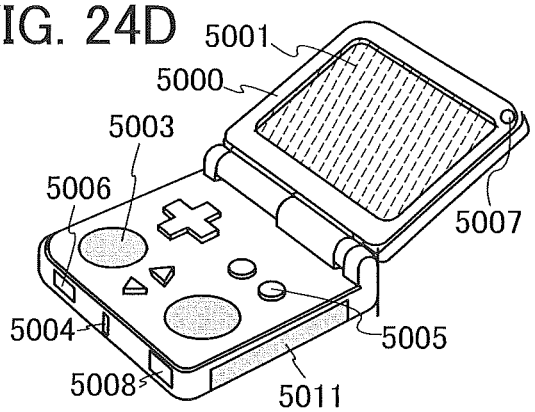
Figure 24E:
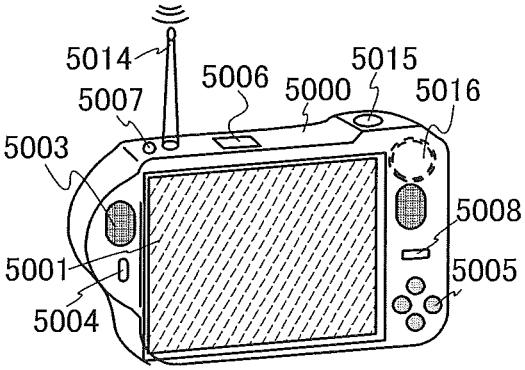
Figure 24F:
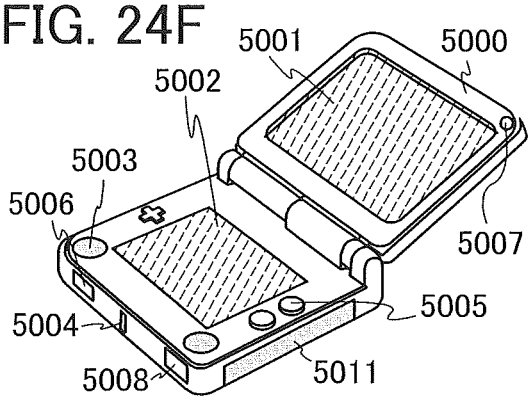
Figure 24G:
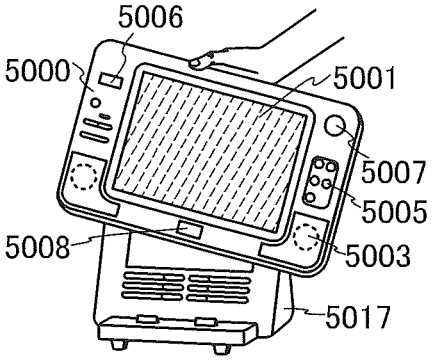

FIG. 24A illustrates a mobile computer that can include a switch 5009, an infrared port 5010, and the like in addition to the above components. FIG. 24B illustrates a portable image reproducing device (e.g., a DVD reproducing device) provided with a recording medium, and the portable image reproducing device can include a second display portion 5002, a recording medium reading portion 5011, and the like in addition to the above components. FIG. 24C illustrates a goggle-type display that can include the second display portion 5002, a support portion 5012, an earphone 5013, and the like in addition to the above components. FIG. 24D illustrates a portable game console that can include the recording medium reading portion 5011 and the like in addition to the above components. FIG. 24E illustrates a digital camera with a television reception function, and the digital camera can include an antenna 5014, a shutter button 5015, an image receiving portion 5016, and the like in addition to the above components. FIG. 24F illustrates a portable game console that can include the second display portion 5002, the recording medium reading portion 5011, and the like in addition to the above components. FIG. 24G illustrates a portable television receiver that can include a charger 5017 capable of transmitting and receiving signals, and the like in addition to the above components.

The electronic devices illustrated in FIGS. 24A to 24G can have a variety of functions such as a function of displaying a variety of data (a still image, a moving image, a text image, and the like) on the display portion, a touch panel function, a function of displaying a calendar, the date, the time, and the like, a function of controlling processing with a variety of software (programs), a wireless communication function, a function of being connected to a variety of computer networks with a wireless communication function, a function of transmitting and receiving a variety of data with a wireless communication function, and a function of reading a program or data stored in a recording medium and displaying the program or data on the display portion. Furthermore, the electronic device including a plurality of display portions can have a function of displaying image data mainly on one display portion while displaying text data mainly on another display portion, a function of displaying a three-dimensional image by displaying images on a plurality of display portions with a parallax taken into account, or the like. Furthermore, the electronic device including an image receiving portion can have a function of shooting a still image, a function of taking moving images, a function of automatically or manually correcting a shot image, a function of storing a shot image in a recording medium (an external recording medium or a recording medium incorporated in the camera), a function of displaying a shot image on the display portion, or the like. Note that functions of the electronic devices in FIGS. 24A to 24G are not limited thereto, and the electronic devices can have a variety of functions.

Figure 24H:
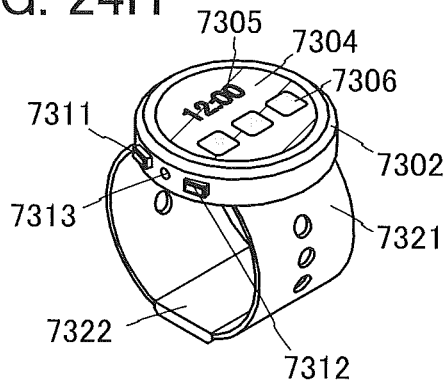

FIG. 24H illustrates a smart watch, which includes a housing 7302, a display panel 7304, operation buttons 7311 and 7312, a connection terminal 7313, a band 7321, a clasp 7322, and the like.

The display panel 7304 mounted in the housing 7302 serving as a bezel includes a non-rectangular display region. The display panel 7304 may have a rectangular display region. The display panel 7304 can display an icon 7305 indicating time, another icon 7306, and the like.

The smart watch in FIG. 24H can have a variety of functions such as a function of displaying a variety of data (e.g., a still image, a moving image, and a text image) on the display portion, a touch panel function, a function of displaying a calendar, date, time, and the like, a function of controlling processing with a variety of software (programs), a wireless communication function, a function of being connected to a variety of computer networks with a wireless communication function, a function of transmitting and receiving a variety of data with a wireless communication function, and a function of reading out a program or data stored in a recording medium and displaying it on the display portion.

The housing 7302 can include a speaker, a sensor (a sensor having a function of measuring force, displacement, position, speed, acceleration, angular velocity, rotational frequency, distance, light, liquid, magnetism, temperature, chemical substance, sound, time, hardness, electric field, current, voltage, electric power, radiation, flow rate, humidity, gradient, oscillation, odor, or infrared rays), a microphone, and the like. Note that the smart watch can be manufactured using a light-emitting element for the display panel 7304.

Unless otherwise specified, an on-state current in this specification refers to a drain current of a transistor in an on state. Unless otherwise specified, the on state of an n-channel transistor means that the voltage ($V_G$) between its gate and source is higher than or equal to the threshold voltage ($V_{th}$), and the on state of a p-channel transistor means that $V_G$ is lower than or equal to $V_{th}$. For example, the on-state current of an n-channel transistor refers to a drain current that flows when $V_G$ is higher than or equal to $V_{th}$. The on-state current of a transistor sometimes depends on a voltage ($V_D$) between a drain and a source.

Unless otherwise specified, an off-state current in this specification refers to a drain current of a transistor in an off state. Unless otherwise specified, the off state of an n-channel transistor means that $V_G$ is lower than $V_{th}$, and the off state of a p-channel transistor means that $V_G$ is higher than $V_{th}$. For example, the off-state current of an n-channel transistor refers to a drain current that flows when $V_G$ is lower than $V_{th}$. The off-state current of a transistor depends on $V_G$ in some cases. Thus, "the off-state current of a transistor is lower than $10^{-21}$ A" may mean there is $V_G$ at which the off-state current of the transistor is lower than $10^{-21}$ A.

The off-state current of a transistor depends on $V_D$ in some cases. Unless otherwise specified, the off-state current in this specification may be an off-state current at $V_D$ with an absolute value of 0.1 V, 0.8 V, 1 V, 1.2 V, 1.8 V, 2.5 V, 3 V, 3.3 V, 10 V, 12 V, 16 V, or 20 V. Alternatively, the off-state current may be an off-state current at $V_D$ used in a semiconductor device or the like including the transistor.

In this specification and the like, the terms "one of a source and a drain" (or a first electrode or a first terminal) and "the other of the source and the drain" (or a second electrode or a second terminal) are used to describe the connection relation of a transistor. This is because a source and a drain of a transistor are interchangeable depending on the structure, operation conditions, or the like of the transistor. Note that the source or the drain of the transistor can also be referred to as a source (or drain) terminal, a source (or drain) electrode, or the like as appropriate depending on the situation.

For example, in this specification and the like, an explicit description "X and Y are connected" means that X and Y are electrically connected, X and Y are functionally connected, and X and Y are directly connected. Accordingly, without being limited to a predetermined connection relationship, for example, a connection relationship shown in drawings or texts, another connection relationship is included in the drawings or the texts.

Here, each of X and Y denotes an object (e.g., a device, an element, a circuit, a wiring, an electrode, a terminal, a conductive film, or a layer).

Examples of the case where X and Y are directly connected include the case where an element that enables electrical connection between X and Y (e.g., a switch, a transistor, a capacitor, an inductor, a resistor, a diode, a display element, a light-emitting element, or a load) is not connected between X and Y, and the case where X and Y are connected without the element that enables electrical connection between X and Y provided therebetween.

For example, in the case where X and Y are electrically connected, one or more elements that enable electrical connection between X and Y (e.g., a switch, a transistor, a capacitor, an inductor, a resistor, a diode, a display element, a light-emitting element, or a load) can be connected between X and Y. Note that the switch is controlled to be turned on or off. That is, the switch is conducting or not conducting (is turned on or off) to determine whether current flows therethrough or not. Alternatively, the switch has a function of selecting and changing a current path. Note that the case where X and Y are electrically connected includes the case where X and Y are directly connected.

For example, in the case where X and Y are functionally connected, one or more circuits that enable functional connection between X and Y (e.g., a logic circuit such as an inverter, a NAND circuit, or a NOR circuit; a signal converter circuit such as a DA converter circuit, an AD converter circuit, or a gamma correction circuit; a potential level converter circuit such as a power supply circuit (e.g., a step-up circuit or a step-down circuit) or a level shifter circuit for changing the potential level of a signal; a voltage source; a current source; a switching circuit; an amplifier circuit such as a circuit capable of increasing signal amplitude, the amount of current, or the like, an operational amplifier, a differential amplifier circuit, a source follower circuit, and a buffer circuit; a signal generator circuit; a memory circuit; and/or a control circuit) can be connected between X and Y. Note that for example, in the case where a signal output from Xis transmitted to Y even when another circuit is provided between X and Y, X and Y are functionally connected. The case where X and Y are functionally connected includes the case where X and Y are directly connected and X and Y are electrically connected.

Note that in this specification and the like, an explicit description "X and Y are electrically connected" means that X and Y are electrically connected (i.e., the case where X and Y are connected with another element or another circuit provided therebetween), X and Y are functionally connected (i.e., the case where X and Y are functionally connected with another circuit provided therebetween), and X and Y are directly connected (i.e., the case where X and Y are connected without another element or another circuit provided therebetween). That is, in this specification and the like, the explicit description "X and Y are electrically connected" is the same as the explicit description "X and Y are connected".

For example, any of the following expressions can be used for the case where a source (or a first terminal or the like) of a transistor is electrically connected to X through (or not through) Z1 and a drain (or a second terminal or the like) of the transistor is electrically connected to Y through (or not through) Z2, or the case where a source (or a first terminal or the like) of a transistor is directly connected to one part of Z1 and another part of Z1 is directly connected to X while a drain (or a second terminal or the like) of the transistor is directly connected to one part of Z2 and another part of Z2 is directly connected to Y.

Examples of the expressions include, "X, Y, a source (or a first terminal or the like) of a transistor, and a drain (or a second terminal or the like) of the transistor are electrically connected to each other, and X, the source (or the first terminal or the like) of the transistor, the drain (or the second terminal or the like) of the transistor, and Y are electrically connected to each other in this order", "a source (or a first terminal or the like) of a transistor is electrically connected to X, a drain (or a second terminal or the like) of the transistor is electrically connected to Y, and X, the source (or the first terminal or the like) of the transistor, the drain (or the second terminal or the like) of the transistor, and Y are electrically connected to each other in this order", and "X is electrically connected to Y through a source (or a first terminal or the like) and a drain (or a second terminal or the like) of a transistor, and X, the source (or the first terminal or the like) of the transistor, the drain (or the second terminal or the like) of the transistor, and Y are provided to be connected in this order". When the connection order in a circuit configuration is defined by an expression similar to the above examples, a source (or a first terminal or the like) and a drain (or a second terminal or the like) of a transistor can be distinguished from each other to specify the technical scope.

Other examples of the expressions include, "a source (or a first terminal or the like) of a transistor is electrically connected to X through at least a first connection path, the first connection path does not include a second connection path, the second connection path is a path between the source (or the first terminal or the like) of the transistor and a drain (or a second terminal or the like) of the transistor, Z1 is on the first connection path, the drain (or the second terminal or the like) of the transistor is electrically connected to Y through at least a third connection path, the third connection path does not include the second connection path, and Z2 is on the third connection path" and "a source (or a first terminal or the like) of a transistor is electrically connected to X at least with a first connection path through Z1, the first connection path does not include a second connection path, the second connection path includes a connection path through which the transistor is provided, a drain (or a second terminal or the like) of the transistor is electrically connected to Y at least with a third connection path through Z2, and the third connection path does not include the second connection path". Still another example of the expression is "a source (or a first terminal or the like) of a transistor is electrically connected to X through at least Z1 on a first electrical path, the first electrical path does not include a second electrical path, the second electrical path is an electrical path from the source (or the first terminal or the like) of the transistor to a drain (or a second terminal or the like) of the transistor, the drain (or the second terminal or the like) of the transistor is electrically connected to Y through at least Z2 on a third electrical path, the third electrical path does not include a fourth electrical path, and the fourth electrical path is an electrical path from the drain (or the second terminal or the like) of the transistor to the source (or the first terminal or the like) of the transistor". When the connection path in a circuit configuration is defined by an expression similar to the above examples, a source (or a first terminal or the like) and a drain (or a second terminal or the like) of a transistor can be distinguished from each other to specify the technical scope.

Note that these expressions are examples and there is no limitation on the expressions. Here, X, Y, Z1, and Z2 each denote an object (e.g., a device, an element, a circuit, a wiring, an electrode, a terminal, a conductive film, or a layer).

Even when independent components are electrically connected to each other in a circuit diagram, one component has functions of a plurality of components in some cases. For example, when part of a wiring also functions as an electrode, one conductive film functions as the wiring and the electrode. Thus, the term "electrical connection" in this specification also means such a case where one conductive film has functions of a plurality of components.

REFERENCE NUMERALS

ACF1: conductive material, AF1: alignment film, AF2: alignment film, ANO: wiring, BG: wiring, BL: wiring, BL1: wiring, BL2: wiring, C1: arrow, C2: arrow, C11: capacitor, C12: capacitor, CF1: coloring film, CF2: coloring film, CL: wiring, Cs1: capacitor, Cs2: capacitor, CSCOM: wiring, DC: sensor circuit, DI1: signal, DI1*a*: signal, DI3: signal, DI3*a*: signal, DO1: signal, DO1*a*: signal, DO1*b*: signal, DO2: signal, DO2*b*: signal, DO3: signal, DO3*a*: signal, DO3*b*: signal, FN: node, FN1: node, FPC1: flexible printed circuit, G1: scan line, G2: scan line, GD: driver circuit, KB1: structure body, M: transistor, M1: transistor, M2: transistor, M3: transistor, M4: transistor, M6: transistor, M7: transistor, MD: transistor, ME: electrode, ML: signal line, OSC: oscillator circuit, P1: sensor signal, R1: arrow, R2: arrow, RB1: wiring, RB2: wiring, RW: wiring, S1: signal line, S2: signal line, SD: driver circuit, SD1: driver circuit, SD2: driver circuit, SE: electrode, SL: control line, SW1: switch, SW2: switch, T1: period, T2: period, T3: period, T4: period, T5: period, T6: period, VCOM1: wiring, VCOM2: wiring, WB1: wiring, WB2: wiring, WW: wiring, 1: display device, 2: display device, 3: display device, 4: display device, 10: host, 11: controller, 12: display panel, 13: circuit, 13*a*: circuit, 13*b*: circuit, 14: frame memory, 14*a*: frame memory, 14*b*: frame memory, 15: circuit, 15*a*: circuit, 15*b*: circuit, 16: control circuit, 16*a*: control circuit, 20: decoder, 21: signal, 21*a*: signal, 21*b*: signal, 22: signal, 22*a*: signal, 22*b*: signal, 30*a*: display element, 30*b*: display element, 31: memory cell, 32: memory cell, 33: memory cell, 34: memory cell, 35: memory cell, 36: memory cell, 231: display region, 240: touch panel, 241: sensor region, 250: input/output panel, 501A: insulating film, 501C: insulating film, 504: conductive film, 505: bonding layer, 506: insulating film, 508: oxide semiconductor film, 508A: region, 508B: region, 508C: region, 511B: conductive film, 511C: conductive film, 511D: conductive film, 512A: conductive film, 512B: conductive film, 516: insulating film, 518: insulating film, 519B: terminal, 519C: terminal, 519D: terminal, 521: insulating film, 524: conductive film, 528: insulating film, 551: electrode, 552: electrode, 553: layer, 570: substrate, 702: pixel, 705: sealant, 720: functional layer, 751: electrode, 751E: region, 751H: opening, 752: electrode, 753: layer, 754A: intermediate film, 754B: intermediate film, 754C: intermediate film, 754D: intermediate film, 770: substrate, 770D: functional film, 770P: functional film, 771: insulating film, 775: sensor element, 5000: housing, 5001: display portion, 5002: display portion, 5003: speaker, 5004: LED lamp, 5005: operation key, 5006: connection terminal, 5007: sensor, 5008: microphone, 5009: switch, 5010: infrared port, 5011: recording medium reading portion, 5012: support portion, 5013: earphone, 5014: antenna, 5015: shutter button, 5016: image receiving portion, 5017: charger, 7302: housing, 7304: display panel, 7305: icon, 7306: icon, 7311: operation button, 7312: operation button, 7313: connection terminal, 7321: band, 7322: clasp This application is based on Japanese Patent Application serial no. 2016-098455 filed with Japan Patent Office on May 17, 2016, the entire contents of which are hereby incorporated by reference.

The invention claimed is:

1. A display device comprising:

a host;

a controller comprising a first write circuit, a second write circuit, a first frame memory, a second frame memory, a first read circuit, a second read circuit, and a control circuit; and a display panel, wherein the host is electrically connected to the first write circuit and the second write circuit, wherein the first write circuit is electrically connected to the first frame memory, and the second write circuit is electrically connected to the second frame memory, wherein the first frame memory is electrically connected to the first read circuit, and the second frame memory is electrically connected to the second read circuit, wherein the first read circuit and the second read circuit are electrically connected to the display panel, wherein the control circuit is configured to determine operation of the first read circuit, wherein a first signal is configured to be supplied to the first write circuit from the host, wherein when the first signal comprises a first image data, the first signal comprises a first command indicating presence of the first image data, wherein when the control circuit detects the first command, the first read circuit supplies a second signal comprising the image data to the display panel, wherein a third signal is configured to be supplied to the second write circuit from the host, wherein when the control circuit does not detect the first command, the first read circuit stops supplying the second signal, and wherein whether or not the third signal comprises a second image data and a second command indicating presence of the second image data, the second read circuit supplies a fourth signal comprising the second image data to the display panel.

2. The display device according to claim 1, wherein after the first read circuit stops supplying the second signal for a predetermined time, the first read circuit resumes supplying the second signal regardless of whether or not the first signal comprises the first command.

3. The display device according to claim 1, wherein the first frame memory comprises a transistor, and wherein the transistor comprises an oxide semiconductor in a channel formation region.

4. A display device comprising:

a host;

a controller; and a display panel comprising a reflective liquid crystal element and a light-emitting element, wherein the host is configured to supply a first signal and a second signal to the controller, wherein the controller is configured to supply a third signal based on the first signal to the display panel when the first signal comprises a first command indicating presence of image data of the reflective liquid crystal element, whereas the controller is configured not to supply the third signal to the display panel when the first signal does not comprise the first command, and wherein the controller is configured to supply a fourth signal based on the second signal to the display panel whether or not the second signal comprises a second command indicating presence of image data of the light-emitting element.

* * * * *